US005944003A

United States Patent [19]

Osanai

[11] Patent Number: 5,944,003

[45] Date of Patent: Aug. 31, 1999

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi, Japan

[21] Appl. No.: 08/908,336

[22] Filed: Aug. 7, 1997

[30] Foreign Application Priority Data

Aug. 9, 1996 [JP] Japan ..... 8-211434

[51] Int. Cl.[6] ..... F02M 33/02

[52] U.S. Cl. ..... 123/698; 123/520

[58] Field of Search ..... 123/698, 520

[56] References Cited

U.S. PATENT DOCUMENTS

| | | | |
|---|---|---|---|
| 4,748,959 | 6/1988 | Cook et al. | 123/698 |
| 5,048,493 | 9/1991 | Orzel et al. | 123/698 |
| 5,143,040 | 9/1992 | Okawa et al. | 123/698 |
| 5,150,686 | 9/1992 | Okawa et al. | 123/698 |
| 5,216,998 | 6/1993 | Hosoda et al. | 123/698 |
| 5,497,757 | 3/1996 | Osanai | 123/698 |
| 5,546,917 | 8/1996 | Osanai et al. | 123/674 |
| 5,727,537 | 3/1998 | Nakagawa et al. | 123/698 |

FOREIGN PATENT DOCUMENTS

| | | |
|---|---|---|
| 62-108549 U | 7/1987 | Japan . |
| 63-189665 | 8/1988 | Japan . |
| 4370359 | 12/1992 | Japan . |
| 552139 | 3/1993 | Japan . |
| 579410 | 3/1993 | Japan . |
| 5223021 | 8/1993 | Japan . |
| 7269419 | 10/1995 | Japan . |

*Primary Examiner*—Erick R. Solis
*Attorney, Agent, or Firm*—Kenyon & Kenyon

[57] ABSTRACT

An evaporated fuel treatment device comprising a purge control valve for controlling an amount of fuel vapor fed into the intake passage from a charcoal canister. The drive pulse of the purge control valve is controlled by a duty ratio. When the engine is idling, if the air-fuel ratio becomes rich, the speed of increase of the duty ratio of the drive pulse of the purge control valve is restricted to less than a predetermined speed.

20 Claims, 20 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

Known in the art is an internal combustion engine provided with a canister for temporarily storing evaporated fuel, a purge control valve for controlling the amount of purge of the fuel vapor to be purged from the canister to the inside of an intake passage, and an air-fuel ratio sensor for detecting an air-fuel ratio, calculating a purge vapor concentration based on the amount of fluctuation of the air-fuel ratio, and correcting an amount of supplied fuel by the calculated purge vapor concentration so that the air-fuel ratio is maintained at a target air-fuel ratio. (see Japanese Unexamined Patent Publication (Kokai) No. 5-52139). In this internal combustion engine, so long as the purge vapor concentration is calculated correctly, the air-fuel ratio can be maintained at the target air-fuel ratio regardless of the operating state of the engine even if a purge action of the fuel vapor is performed.

Sometimes, however, the purge vapor concentration will change by a large margin if the engine operating state changes in the middle of engine operation. For example, at the time of deceleration, the purge action is normally suspended. If a large amount of fuel vapor is adsorbed by the activated carbon in the canister during this time, however, the purge vapor concentration will increase by a large margin when the purge action is restarted.

If the purge vapor concentration increases by a large margin in this way, however, the air-fuel ratio will become rich. If the air-fuel ratio becomes rich, the purge vapor concentration will start to be calculated based on the amount of fluctuation of the air-fuel ratio, but it will take time until the purge vapor concentration is accurately calculated. Therefore, for a while after the purge vapor concentration increases by a large margin, the air-fuel ratio will end up deviating to the rich side with respect to the target air-fuel ratio.

When the air-fuel ratio deviates to the rich side of the target air-fuel ratio in this way, however, if the opening degree of the purge control valve is increased rapidly, the amount of purge of a high concentration fuel vapor will be rapidly increased and therefore the air-fuel ratio will shift further to the rich side. Therefore, the air-fuel ratio will fluctuate widely.

On the other hand, part of the evaporated fuel occurring in the fuel tank is adsorbed by the activated carbon in the canister, while the remaining evaporated fuel is directly fed into the engine intake passage. In this case, the evaporated fuel fed from the fuel tank directly into the engine intake passage will depend not on the magnitude of the negative pressure occurring in the intake passage, but will depend on the amount of the evaporated fuel occurring in the fuel tank. Therefore, if the amount of intake air changes, for example, if the amount of intake air increases, the amount of purge per unit amount of intake air will decrease, so the purge vapor concentration will decrease by a large margin. As a result, the air-fuel ratio will end up deviating to the lean side of the target air-fuel ratio.

When the air-fuel ratio deviates to the lean side of the target air-fuel ratio in this way, however, if the opening degree of the purge control valve is rapidly increased, the amount of purge of the low concentration fuel vapor will be rapidly increased, so the air-fuel ratio will deviate even further to the lean side and therefore the air-fuel ratio will fluctuate by a larger margin.

In this way, if the opening degree of the purge control valve is rapidly increased when the air-fuel ratio deviates from the target air-fuel ratio, the air-fuel ratio will fluctuate by a large margin.

SUMMARY OF THE INVENTION

An object of the present invention is to provide an evaporated fuel treatment device capable of preventing an air-fuel ratio from fluctuating by a large margin when the purge operation of fuel vapor is carried out.

According to the present invention, there is provided an evaporated fuel treatment device for an engine provided with an intake passage, comprising a purge control valve for controlling an amount of purge of fuel vapor to be purged to the intake passage; air-fuel ratio detecting means for detecting the air-fuel ratio; feedback control means for feedback control of the air-fuel ratio to make the air-fuel ratio a target air-fuel ratio; purge vapor concentration calculating means for calculating a purge vapor concentration based on an amount of fluctuation of the air-fuel ratio; correcting means for correcting an amount of fuel to be supplied to the engine by the purge vapor concentration calculated by the purge vapor concentration calculating means; judgement means for judging if the purge vapor concentration calculated by the purge vapor concentration calculating means deviates from an actual purge vapor concentration; and opening speed restricting means for restricting a speed of opening of the purge control valve to less than a predetermined speed when deviation occurs.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
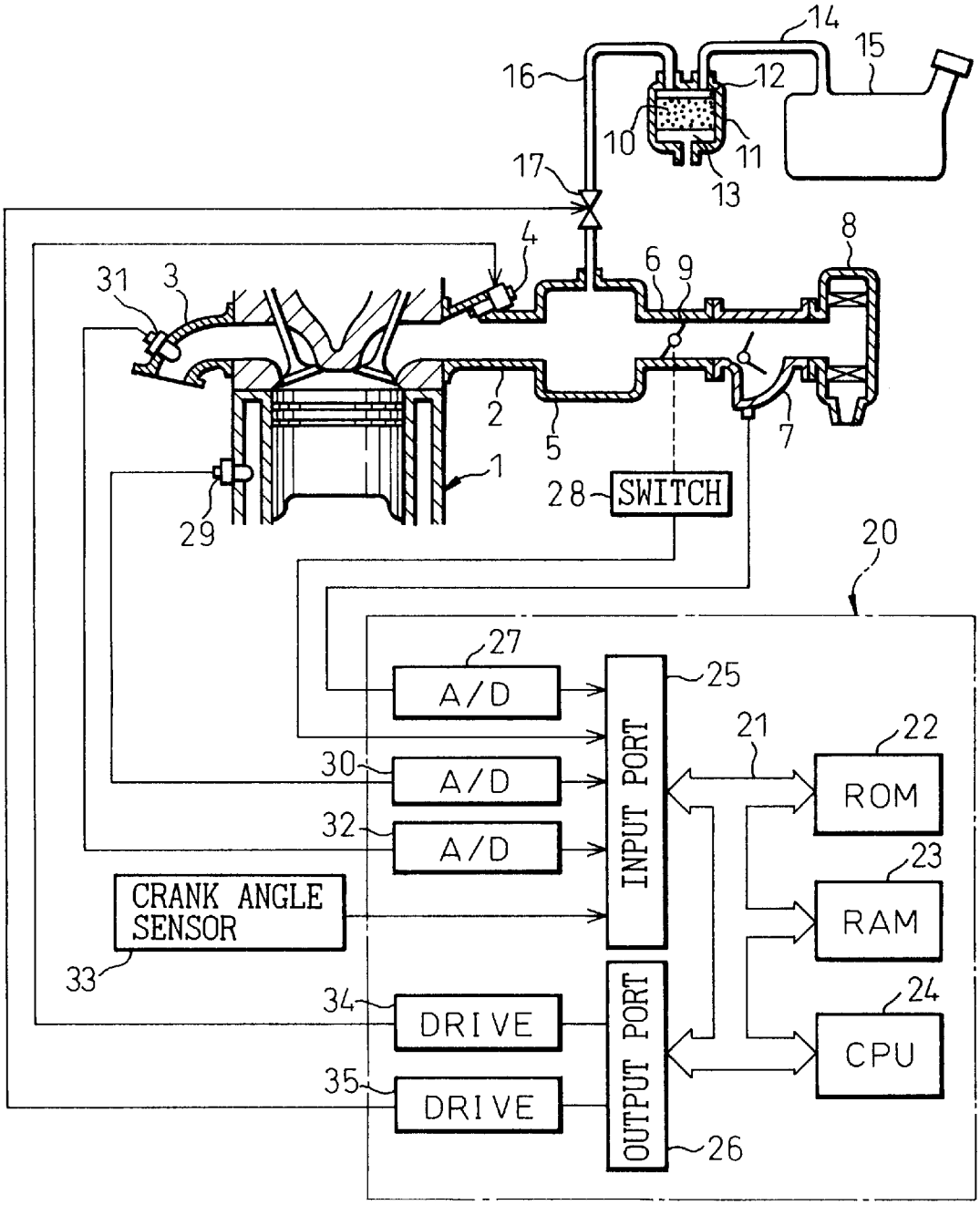
FIG. 1 is an overall view of an internal combustion engine.

Referring to FIG. 1, 1 is an engine body, 2 an intake tube, 3 an exhaust manifold, and 4 a fuel injector attached to each of the intake pipes 2. Each intake pipe 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM 22 as a function of the engine load Q/N (amount of intake air Q/engine speed N) and the engine speed N.

The correction coefficient K expresses the engine warmup increase coefficient and the acceleration increase coefficient all together. When no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9 V when the air-fuel ratio is rich and generates an output voltage of about 0.1 V when the air-fuel ratio is lean. First, an explanation will be made of the control of the feedback correction coefficient FAF performed based on the output signal of this $O_2$ sensor 31.

Figure 2:
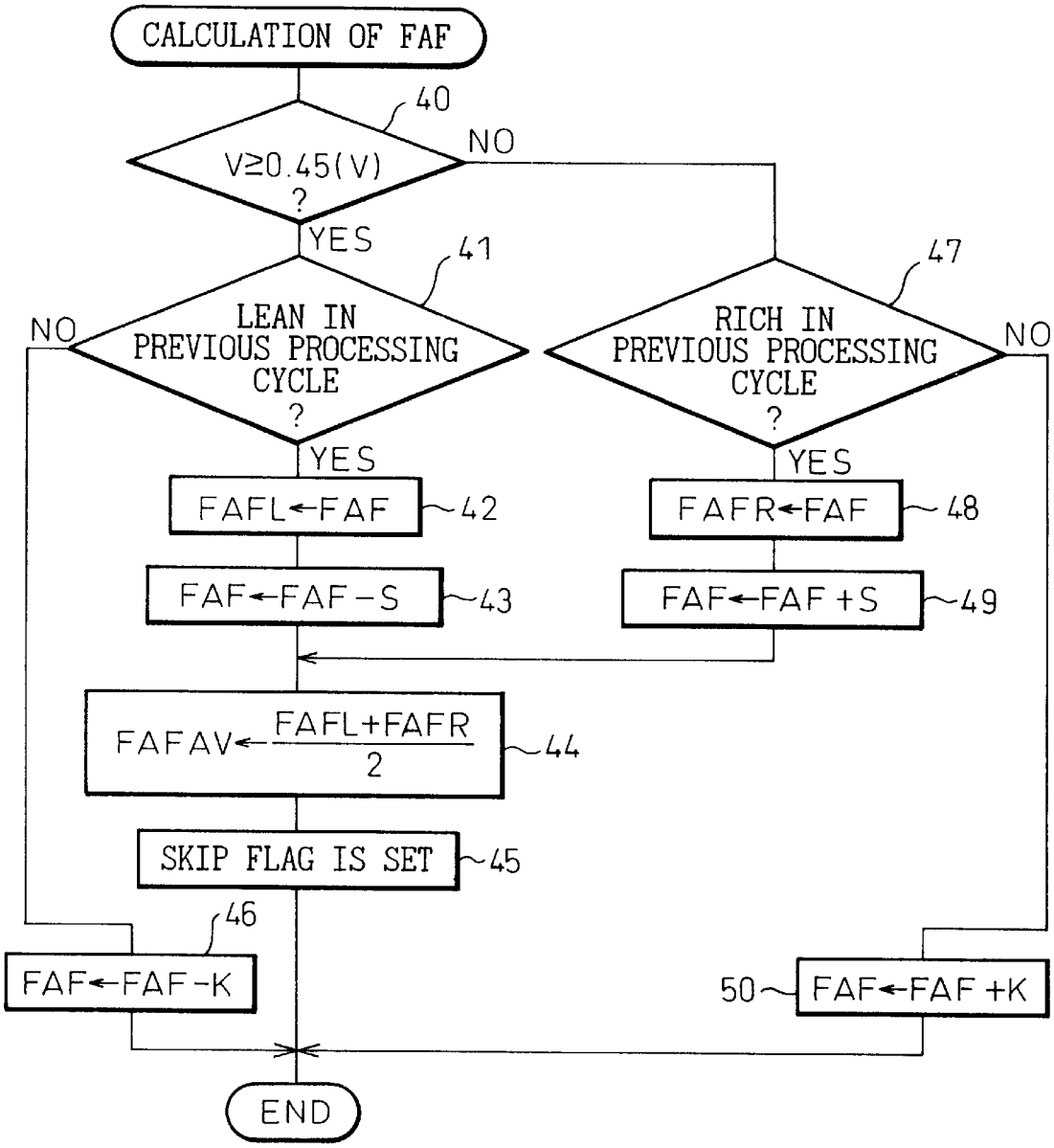
FIG. 2 is a flow chart of a routine for calculating an air-fuel ratio feedback correction coefficient FAF.

FIG. 2 shows the routine for calculation of the feedback correction coefficient FAF. This routine is executed for example within a main routine.

Figure 3:
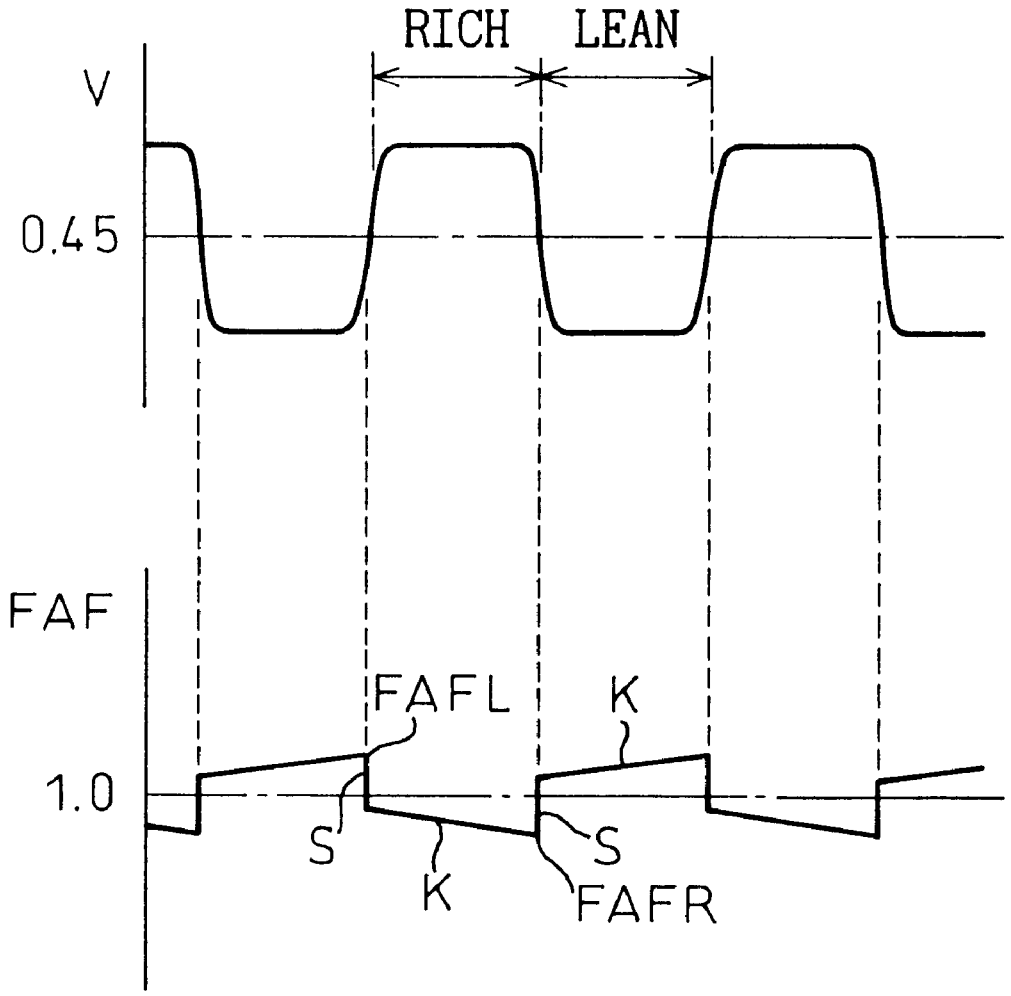
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45 V or not, that is, whether the air-fuel ratio is rich or not. When $V \geqq 0.45$ V, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip value S is subtracted from the feedback control coefficient FAF, therefore, as shown in FIG. 3, the feedback control coefficient FAF is rapidly reduced by the skip value S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K (K<<S) is subtracted from the feedback control coefficient FAF. Therefore, as shown in FIG. 2, the feedback control coefficient FAF is gradually reduced.

On the other hand, when it is judged at step 40 that $V<0.45$ V, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

As will be understood from FIG. 3, the feedback control coefficient FAF is made to change relatively slowly by the integral constant K, so if a large amount of fuel vapor is rapidly purged into the surge tank 5 and the air-fuel ratio rapidly fluctuates, it no longer becomes possible to maintain the air-fuel ratio at the stoichiometric air-fuel ratio and therefore the air-fuel ratio fluctuates. Therefore, in the embodiment shown in FIG. 1, to prevent the air-fuel ratio from fluctuating, when the purge is performed, the amount of the purge is gradually increased. That is, in the embodiment shown in FIG. 1, by controlling the duty ratio of the drive pulse applied to the purge control valve 17, the amount of opening of the purge control valve 17 is controlled. When the purge is started, the duty ratio of the drive pulse is gradually increased. If the duty ratio of the drive pulse is gradually increased in this way, that is, if the amount of purge is gradually increased, even during the increase in the amount of the purge, the air-fuel ratio will be maintained at the stoichiometric air-fuel ratio by the feedback control by the feedback control coefficient FAF, therefore it is possible to prevent the air-fuel ratio from fluctuating.

Next, an explanation will be made of the routine for calculation of the fuel injection time TAU referring to FIG. 4. This routine is executed repeatedly.

Figure 4:
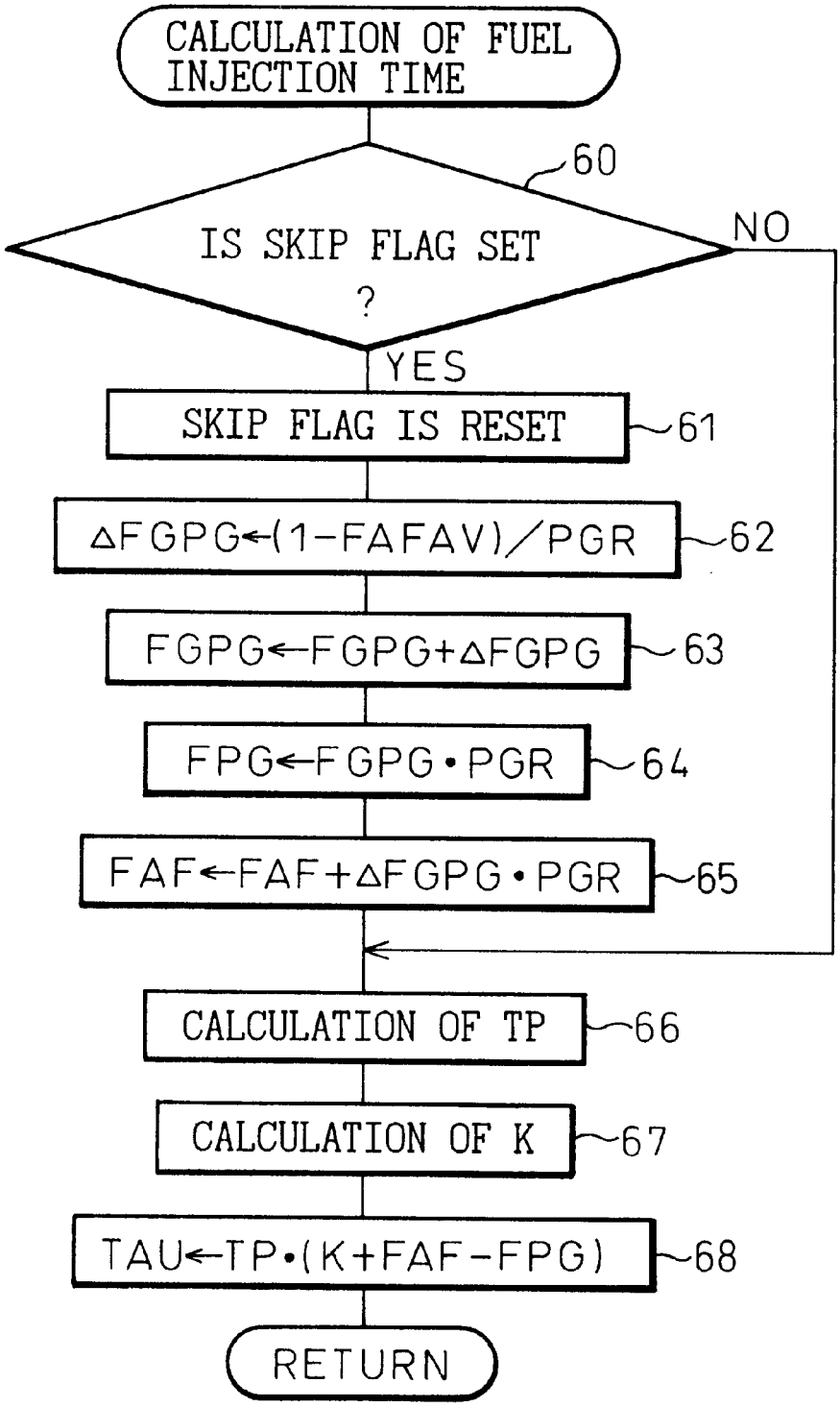
FIG. 4 is a flow chart of a routine for calculating a fuel injection time.

Referring to FIG. 4, first, at step 60, it is judged if the skip flag which is set at step 45 of FIG. 2 has been set or not. When the skip flag has not been set, the routine jumps to step 66. As opposed to this, when the skip flag has been set, the routine proceeds to step 61, where the skip flag is reset, then the routine proceeds to step 62, where the purge vapor concentration AFPGA per unit purge rate is calculated based on the following formula:

$$\Delta FPGA=(1-FAFAV)/PGR$$

That is, the amount of fluctuation (1−FAFAV) of the average air-fuel ratio FAFAV shows the purge vapor concentration therefore by dividing (1−FAFAV) by the purge rate PGR, the purge vapor concentration AFPGA per unit purge rate is calculated. Note that the purge rate PGR expresses the actual purge rate of the fuel vapor. This purge rate PGR is calculated in a routine explained later.

Next, at step 63, the purge vapor concentration ΔFPGA is added to the purge vapor concentration FPGA to update the purge vapor concentration FPGA per unit purge rate. When FAFAV approaches 1.0, ΔFPGA approaches zero, therefore FPGA approaches a constant value. Next, at step 64, the purge rate PGR is multiplied with FPGA to calculate the purge A/F correction coefficient FPG (=FPGA·PGR). Next, at step 65, ΔFPGA·PGR is added to FAF so as to increase the feedback control coefficient FAF by exactly the amount of the increase of the purge A/F correction coefficient FPG. Next, at step 66, the basic fuel injection time TP is calculated, then at step 67, the correction coefficient K is calculated, then at step 68, the injection time TAU (=TP·(k+FAF=FPG)) is calculated.

Figure 5:
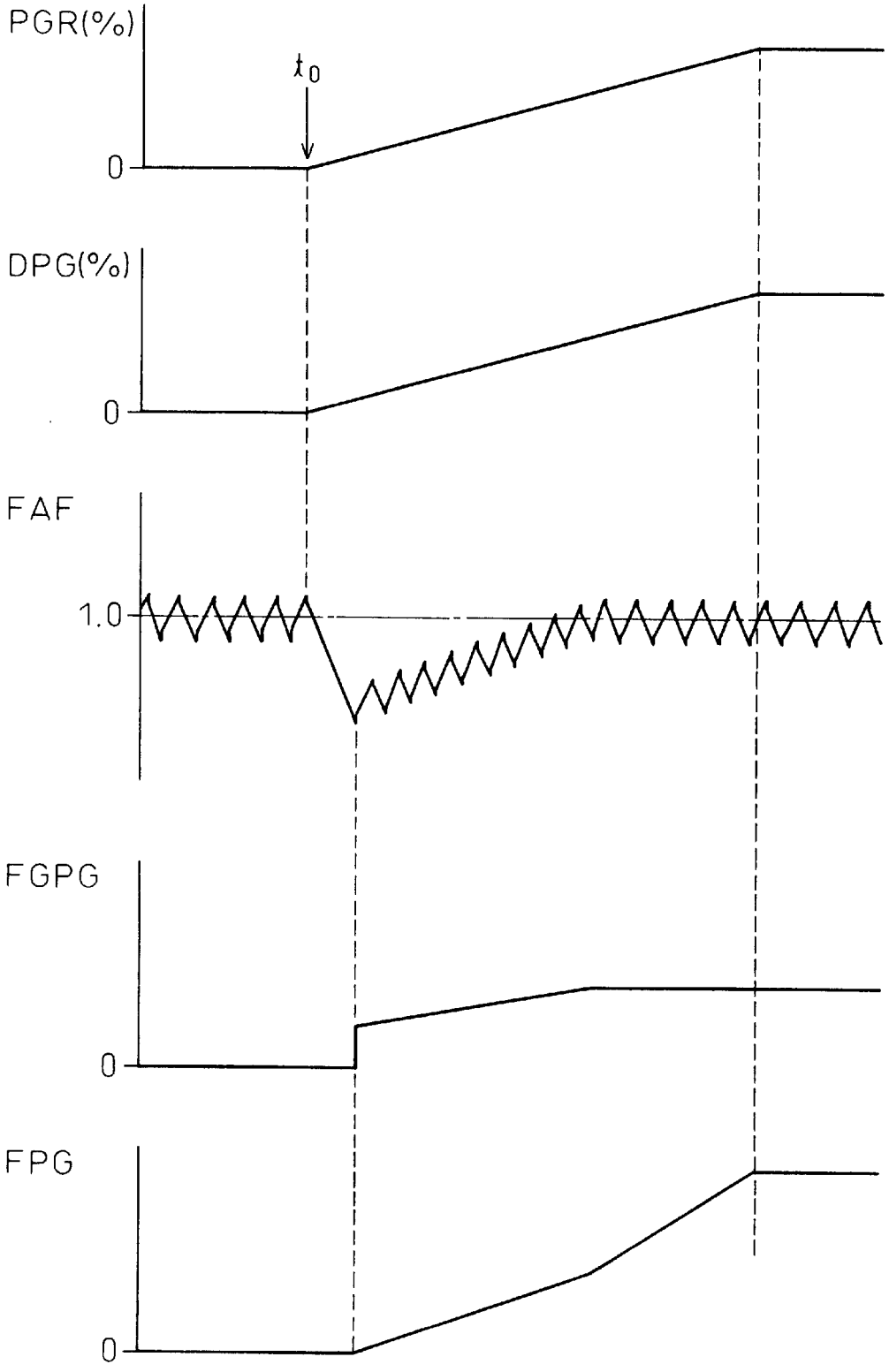
FIG. 5 is a view of changes in the purge vapor concentration FGPG etc.

FIG. 5 shows the changes in the purge vapor concentration FGPG and the purge A/F correction coefficient FPG per unit purge rate at the time when the purge action is started at the time $t_0$. In this embodiment of the present invention, when the purge action is started, the duty ratio DPG of the drive pulse with respect to the purge control valve 17 is gradually increased, that is, the amount of opening of the purge control valve 17 is gradually increased, so the fuel purge rate PGR is gradually increased. On the other hand, when the purge action of the fuel purge is started, normally the ratio of the fuel in the intake air is increased, so the air-fuel ratio becomes richer by the amount of increase of the fuel ratio and as a result the feedback correction coefficient FAF becomes smaller as shown in FIG. 5.

The amount of reduction of the feedback correction coefficient FAF corresponds to the amount of increase of the fuel ratio due to the purge action, that is, the amount of increase of the purge vapor concentration FGPG per unit purge rate, therefore if the feedback correction coefficient FAF falls, the purge vapor concentration FGPG will be increased. Further, if the purge vapor concentration FGPG is increased, the purge A/F correction coefficient FPG will also be gradually increased.

On the other hand, if the purge A/F correction coefficient FPG is increased, the feedback correction coefficient FAF will be increased along with it. If the average value FAFAV of the feedback correction coefficient is returned to 1.0, the purge vapor concentration FGPG will become a constant value. At this time, the learning of the purge vapor concentration FGPG is ended. The purge vapor concentration FGPG at this time shows the actual purge vapor concentration in the intake air.

As mentioned at the start, however, when the air-fuel ratio deviates from the target air-fuel ratio, if the purge control valve 17 is rapidly opened, the air-fuel ratio will fluctuate by a large margin. Further, when the purge vapor concentration FGPG is high, a fluctuation in the amount of purge will have a large effect on the air-fuel ratio. Therefore, when the purge vapor concentration is high, if the purge control valve 17 is rapidly opened, the air-fuel ratio will fluctuate by a large margin. Accordingly, in this embodiment of the present invention, when the air-fuel ratio deviates from the target air-fuel ratio and when the purge vapor concentration FGPG is high, the speed of opening of the purge control valve 17 is restricted to less than a predetermined speed.

Figure 6:
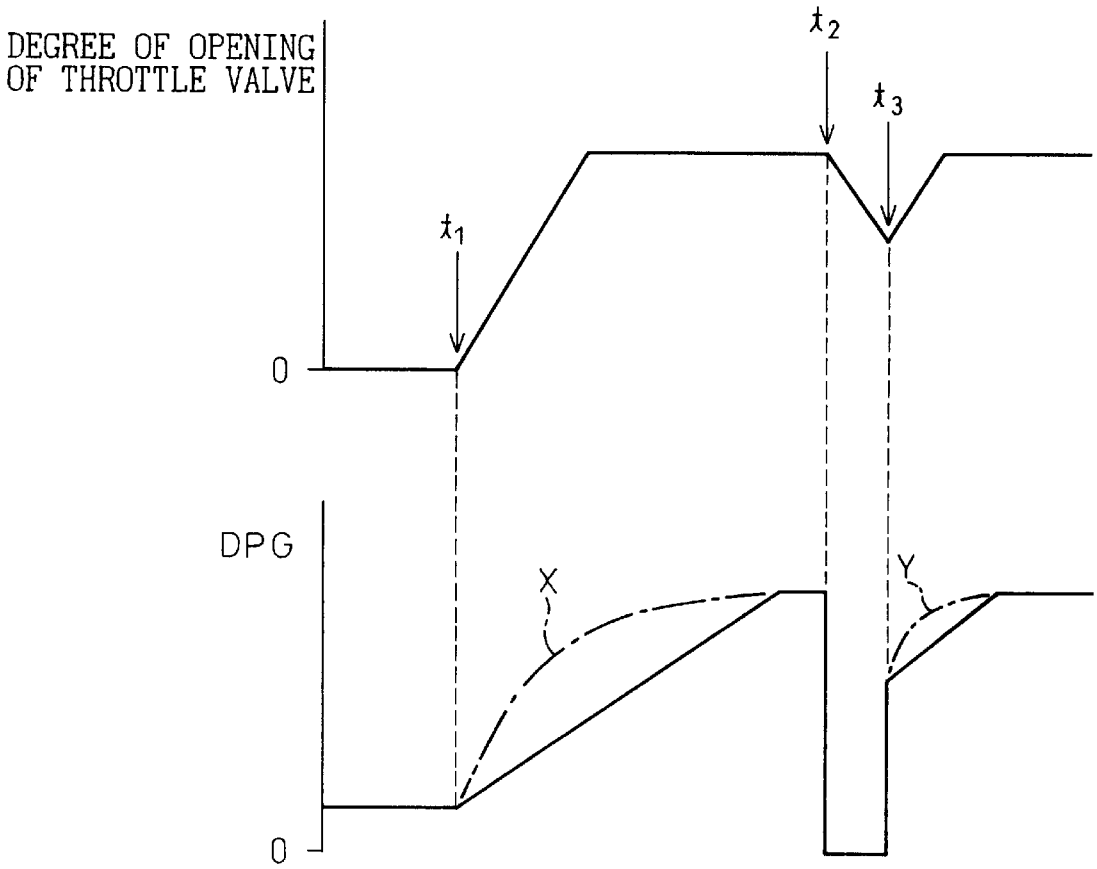
FIG. 6 is a view of changes in a duty ratio DPG.

Next,an explanation will be made of the control of the speed of opening of the purge control valve 17 according to the present invention referring to FIG. 6 showing the relationship between the throttle opening degree and the duty ratio DPG of the drive pulse of the purge control valve 17.

As shown in FIG. 6, at the time $t_1$, when the throttle opening degree is increased from the idling opening degree, normally the duty ratio DPG is made to rise sharply as shown by the broken line X. That is, the amount of opening of the purge control valve 17 is rapidly increased. At this time, however, if the air-fuel ratio deviates from the target air-fuel ratio or the purge vapor concentration FGPG is high, the speed of increase of the duty ratio DPG is restricted as shown by the solid line so that the duty ratio DPG is increased by a constant speed of opening.

Next, when a deceleration operation is started at the time $t_2$ and the fuel injection is stopped, the duty ratio DPG is made zero. That is, the purge control valve 17 is closed and the use of a purge operation is stopped.

Next, when the throttle opening degree is again increased at the time $t_3$, the duty ratio DPG normally is made to rapidly rise as shown by the broken line Y. If the air-fuel ratio deviates from the target air-fuel ratio at this time or the purge vapor concentration FGPG is high, the speed of increase of the duty ratio DPG is restricted as shown by the solid line so that the duty ratio DPG is increased by a constant speed of opening.

Next, an explanation will be made of a first embodiment of a routine for control of the purge with reference to FIG. 7 to FIG. 9. Note that this routine is executed by interruption every predetermined time.

Figure 7:
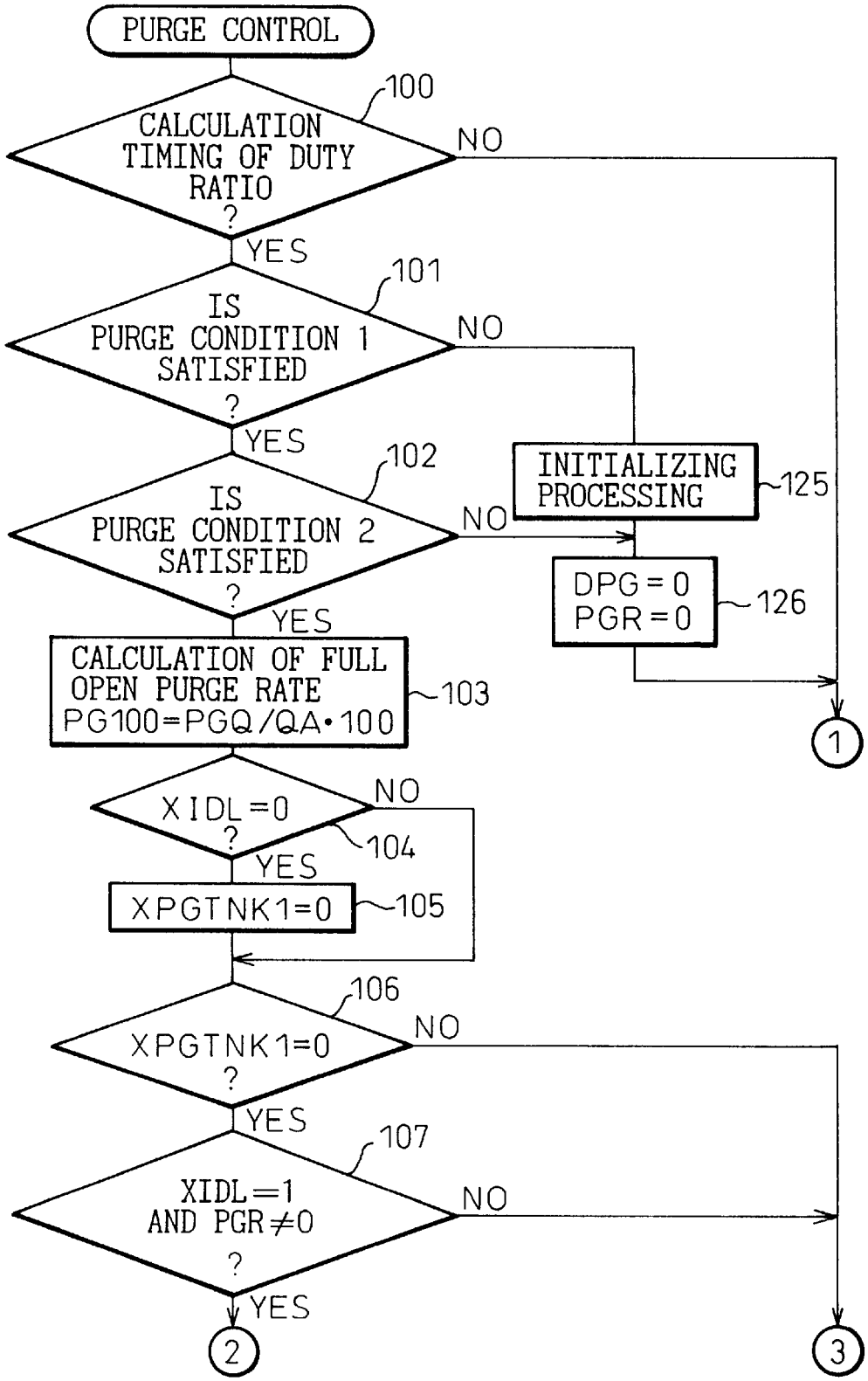
FIGS. 7 to 9 are flow charts for the execution of a first embodiment of the purge control.
Figure 8:
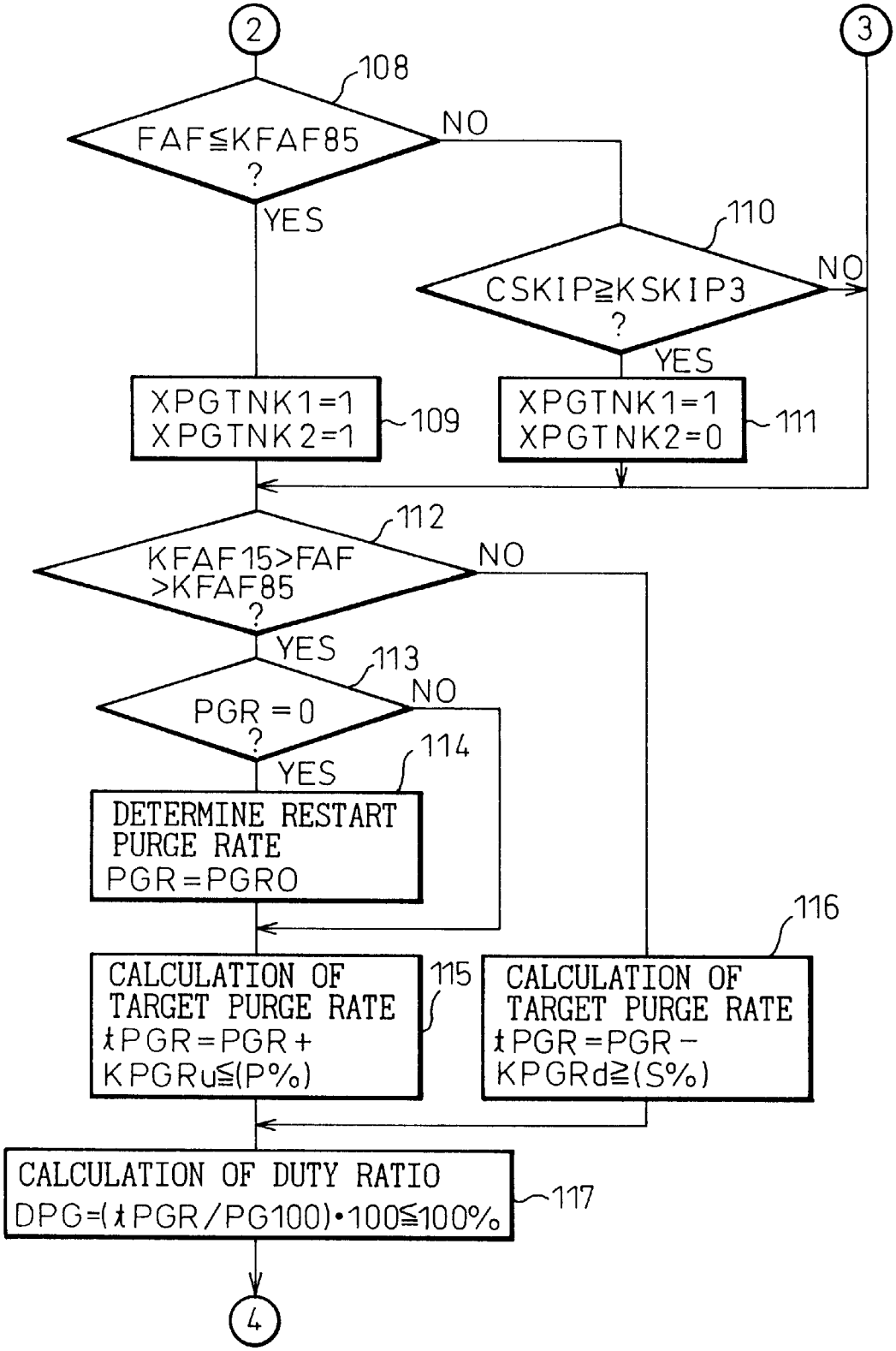
Figure 9:
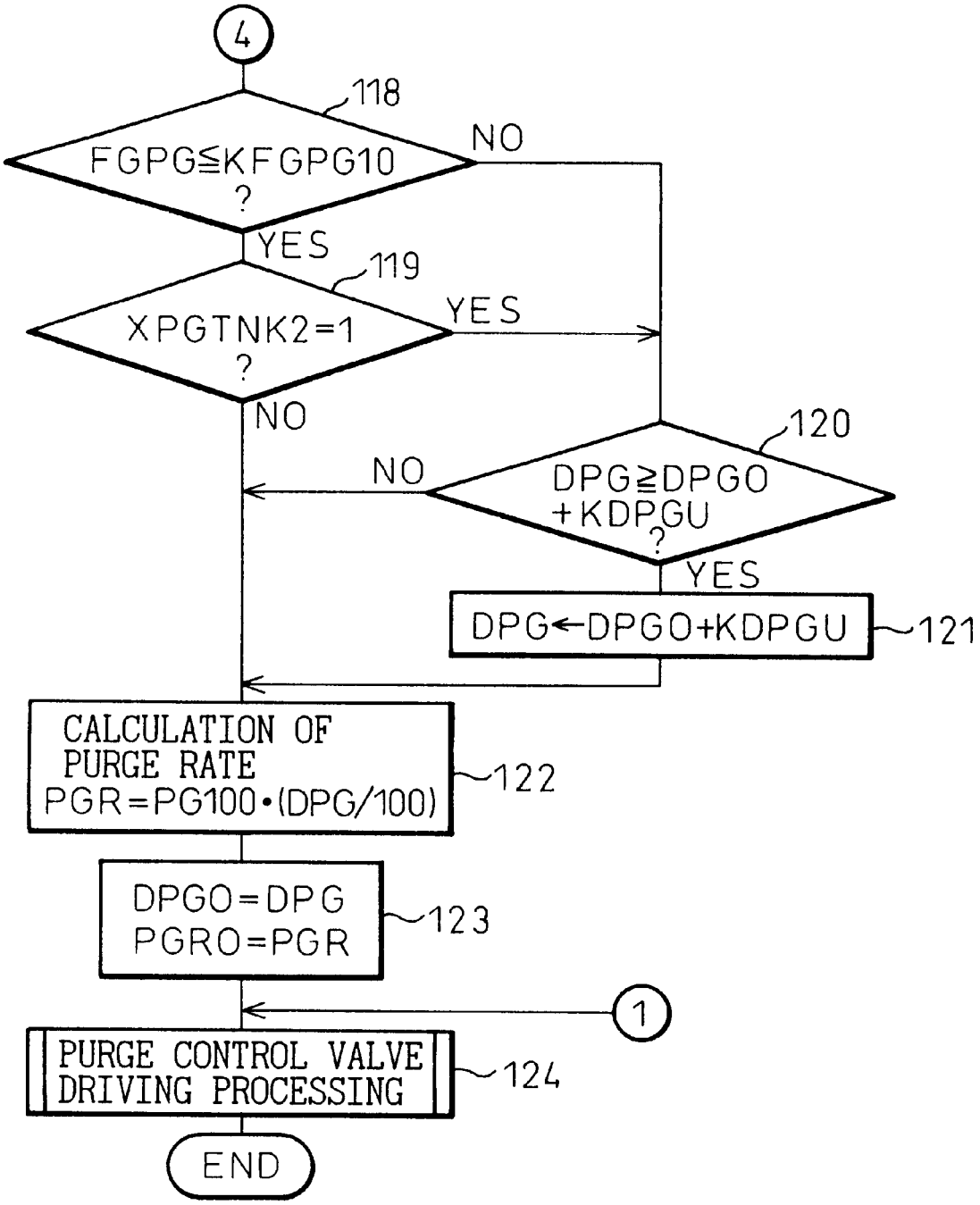

Referring to FIG. 7 to FIG. 9, first, at step 100, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 124, where the processing for driving the purge control valve 17 is executed. As opposed to this, when it is the time for calculation of the duty ratio, the routine proceeds to step 101, where it is Judged if the purge condition 1 is satisfied or not, for example, if the engine warmup has been completed or not. When the purge condition 1 is not satisfied, the routine proceeds to step 125, where the initialization processing is performed, then at step 126, the duty ratio DPG and the purge rate PGR are made zero.

As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 126, while 10 when the purge condition 2 is satisfied, the routine proceeds to step 103.

At step 103, the ratio between the full open purge amount PGQ and the amount QA of intake air, that is, the full open purge rate PG100 (=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so as shown in Table 1, the full open purge rate PG100 becomes larger the lower the engine load Q/N becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the idling flag XIDL, which is set when the engine operating state is an idling state, has been reset (XIDL=0) or not. When the idling flag XIDL is set (XIDL=1), that is, when the engine is idling, the routine jumps to step 106, while when the idling flag XIDL is reset, that is, the engine is not in the idling state, the routine proceeds to step 105, where the judgement completion flag XPGTNK1 is reset (XPGTNK1=0), then the routine proceeds to step 106. The judgement completion flag XPGTNK1 is set when the judgement of whether the air-fuel ratio has deviated from the stoichiometric air-fuel ratio has been completed (XPGTNK1=1).

At step 106, it is judged if the judgement completion flag XPGTNK1 has been reset or not. When the judgement completion flag XPGTNK1 is set, that is, when the judgement of deviation of the air-fuel ratio is completed, the routine jumps to step 112. As opposed to this, when the judgement completion flag XPGTNK1 is reset, that is, the judgement of the deviation of the air-fuel ratio has not been completed, the routine proceeds to step 107, where it is judged if the condition for judgement of deviation of the air-fuel ratio is satisfied or not. It is judged that the condition for judgement of deviation of the air-fuel ratio is satisfied when the idling flag XIDL is set and the purge rate PGR is not zero, that is, during an engine idling operation where the purge action of the fuel vapor is performed. When the condition for judgement of the deviation of the air-fuel ratio is not satisfied, the routine jumps to step 112, while when the condition for judgement of the deviation of the air-fuel ratio is satisfied, the routine proceeds to step 108.

At step 108, it is judged if the feedback correction coefficient FAF has become smaller than the set value KFAF85 (=0.85) or not. When FAF>KFAF85, the routine proceeds to step 110, where it is judged if the number of occurrences CSKIP of the skip (S in FIG. 3) of the feedback correction coefficient FAF has exceeded a set number KSKIP3, for example, three times, or not. The fact that the number of occurrences of skips exceeds three means that the feedback control of the air-fuel ratio is stable. When CSKIP<KSKIP3, the routine jumps to step 112. As opposed to this, when CSKIP≧KSKIP3, the routine proceeds to step 111, where the judgement completion flag XPGTNK1 is set (XPGTNK1=1) and the rich flag XPGTNK2 showing that the air-fuel ratio has become rich is reset (XPGTNK2=0).

On the other hand, when it is judged at step 108 that FAF≦KFAF85, the routine proceeds to step 109, where the judgement completion flag XPGTNK1 is set (XPGTNK1=1) and the rich flag XPGTNK2 is set (XPGTNK2=1). That is, if FAF≦KFAF85 before the skip action of the feedback correction coefficient FAF occurs three times, the rich flag XPGTNK2 is set. Until the skip action of the feedback correction coefficient FAF is performed three times, the rich flag XPGTNK2 will be reset if FAF>KFAF85. The fact that FAF≦KFAF85 means that the air-fuel ratio is rich, that is, the air-fuel ratio deviates from the stoichiometric air-fuel ratio, therefore when the air-fuel ratio deviates from the stoichiometric air-fuel ratio, the rich flag XPGTNK2 is set.

Next, at step 112, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 113, where it is judged whether the purge rate PGR is zero or not. That is, when the purge action is being performed, PGR>0, so at this time the routine jumps to step 115. As opposed to this, when the purge action has not started, the routine proceeds to step 114, where the purge rate PGR0 is made the restart purge rate PGR. When the purge condition 1 and the purge condition 2 are satisfied for the first time since the start of operation of the engine, the purge rate PGR0 is made zero by the initialization processing (step 125), so at this time PGR=0. As opposed to this, when the purge action has been suspended once and then the purge control is resumed, the purge rate PGR0 at the time when the purge control had been suspended is made the restart purge rate PGR.

Next, at step 115, the target purge rate tPGR (=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit value P (P is for example 6%) is set for this target purge rate tPGR, therefore the target purge rate tPGR can only rise up to this upper limit value P. Next, the routine proceeds to step 117.

On the other hand, when it is judged at step 112 that FAF≧KFAF15 or FAF≦KFAF85, the routine proceeds to step 116, where the constant value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 117.

At step 117, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate LTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 118, it is judged if the purge vapor concentration FGPG is lower than the set value KFPGP10, for example, 10 percent, or not. When FGPG≦KFGPG10, the routine proceeds to step 119, where it is judged if the rich flag XPGTNK2 has been set or not. When the rich flag XPGTNK2 has been reset, the routine proceeds to step 122. As opposed to this, when FGPG>KFGPG10 at step 118, that is, when the purge vapor concentration FGPG is high, the routine proceeds to step 120. Further, when it is judged at step 119 that the rich flag XPGTNK2 is set, that is, the air-fuel ratio deviates from the stoichiometric air-fuel ratio, the routine proceeds to step 120.

At step 120, it is judged if the duty ratio DPG calculated at step 117 is larger than the value of the previously calculated duty ratio DPG0 plus a constant value KDPGU (DPG0+KDPGU) or not. Here, the constant value KDPGU is a value for restricting the speed of opening of the purge control valve 17 and therefore is a relatively small value. When DPG<DPG0+KDPGU, the routine jumps to step 122, while when DPG≧DPG0+KDPGU, the routine proceeds to step 121 where (DPG0+KDPGU) is made the duty ratio DPG. Next, the routine proceeds to step 122.

That is, when the duty ratio DPG increases by only less than the constant value KDPGU, the duty ratio calculated at step 117 is used as it is as the duty ratio. When the duty ratio DPG increases by more than the constant value KDPGU, the amount of increase of the duty ratio DPG is controlled to the constant value KDPGU. In other words, when the speed of opening of the purge control valve 17 becomes more than a constant speed, the speed of opening of the purge control valve 17 is restricted to a constant speed.

At step 122, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 123, the duty ratio DPG is made DPG0 and the purge rate PGR is made PGR0. Next, at step 124, processing is performed to drive the purge control valve 17. This drive processing is shown in FIG. 10, therefore, an explanation will next be made of the drive processing of FIG. 10.

Figure 10:
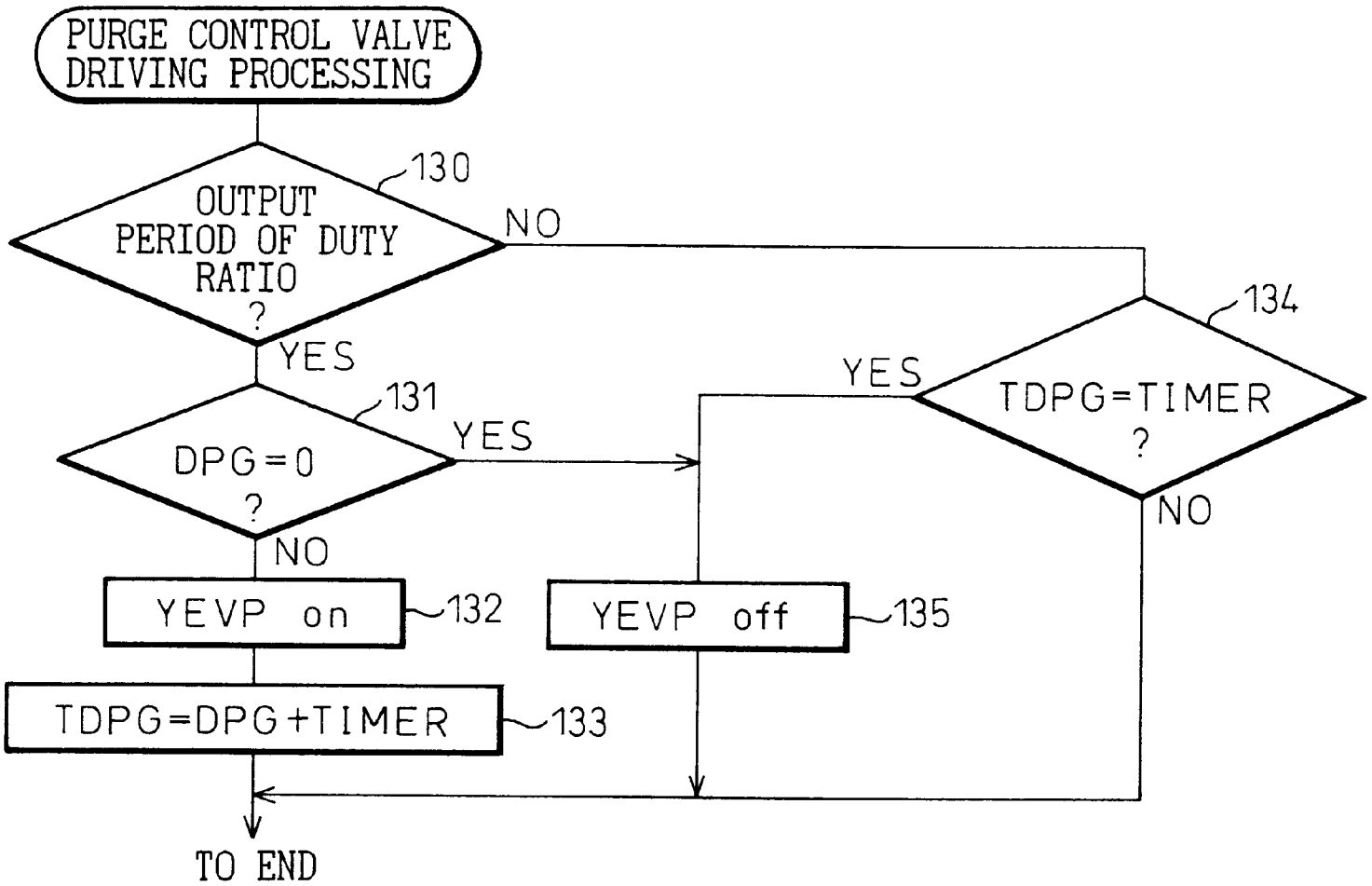
FIG. 10 is a flow chart for the processing for driving the purge control valve.

Referring to FIG. 10, first, at step 130, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 131, where it is judged if the duty ratio DPG is zero or not. When DPG=0, the routine proceeds to step 135, where the drive pulse YEVP of the purge control valve 17 9 is turned off. As opposed to this, when DPG=0, the routine proceeds to step 132, where the drive pulse YEVP of the purge control valve 17 is turned on. Next, at step 133, the duty ratio DPG is added to the current time TIMER to calculate the off time TDPG of the drive pulse (=DPG+TIMER).

On the other hand, when it is judged at step 130 that the output period of the duty ratio has not arrived, the routine proceeds to step 134, where it is judged if the current time TIMER is the off time TDPG of the drive pulse. When TDPG=TIMER, the routine proceeds to step 135, where the drive pulse YEVP is turned off.

When the amount of evaporated fuel in the fuel tank 15 is small and therefore the evaporated fuel supplied from the fuel tank 15 directly to the intake passage is small and when the amount of the evaporated fuel occurring in the fuel tank 15 or the amount of the fuel vapor adsorbed in the activated carbon of the canister 11 does not rapidly change, if the full open purge rate PG100 is used to calculate the duty ratio DPG, the purge rate will be held at the target purge rate tPGR and the air-fuel ratio will not fluctuate regardless of the engine operating state.

If the amount of the evaporated fuel supplied from inside the fuel tank 15 directly to the intake passage increases, however, as mentioned above, the air-fuel ratio will fluctuate when the amount of intake air increases. In this case, if the engine operating state changes to an idling state, the air-fuel ratio will become rich. Since the air-fuel ratio turns rich at the time of engine idling, the air-fuel ratio will fluctuate when the amount of intake air changes, that is the air-fuel ratio will deviate from the stoichiometric air-fuel ratio.

Further, when the engine is idling, the temperature in the fuel tank 15 and canister 11 easily rises. If the temperature in the fuel tank 15 and canister 11 rises at this time and large amount of fuel vapor is supplied into the intake passage, the air-fuel ratio will become rich. When the air-fuel ratio deviates from the stoichiometric air-fuel ratio in this way, the air-fuel ratio will fluctuate if the purge control valve 17 is rapidly opened as explained at the start. Therefore, in the present invention, the speed of opening of the purge control valve 17 is restricted to a constant speed at this time.

Figure 11:
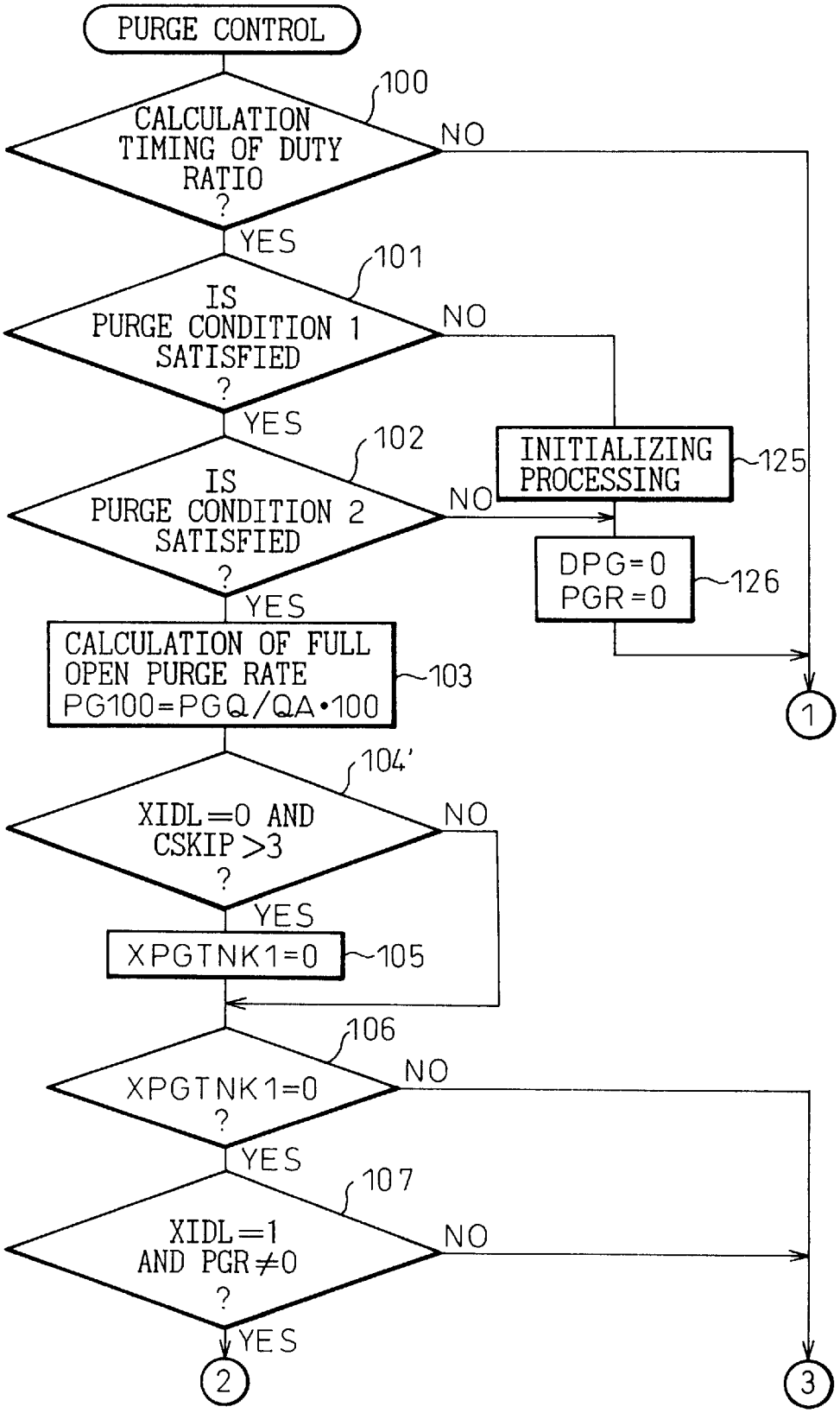
FIGS. 11 to 13 are flow charts for the execution of a second embodiment of the purge control.
Figure 12:
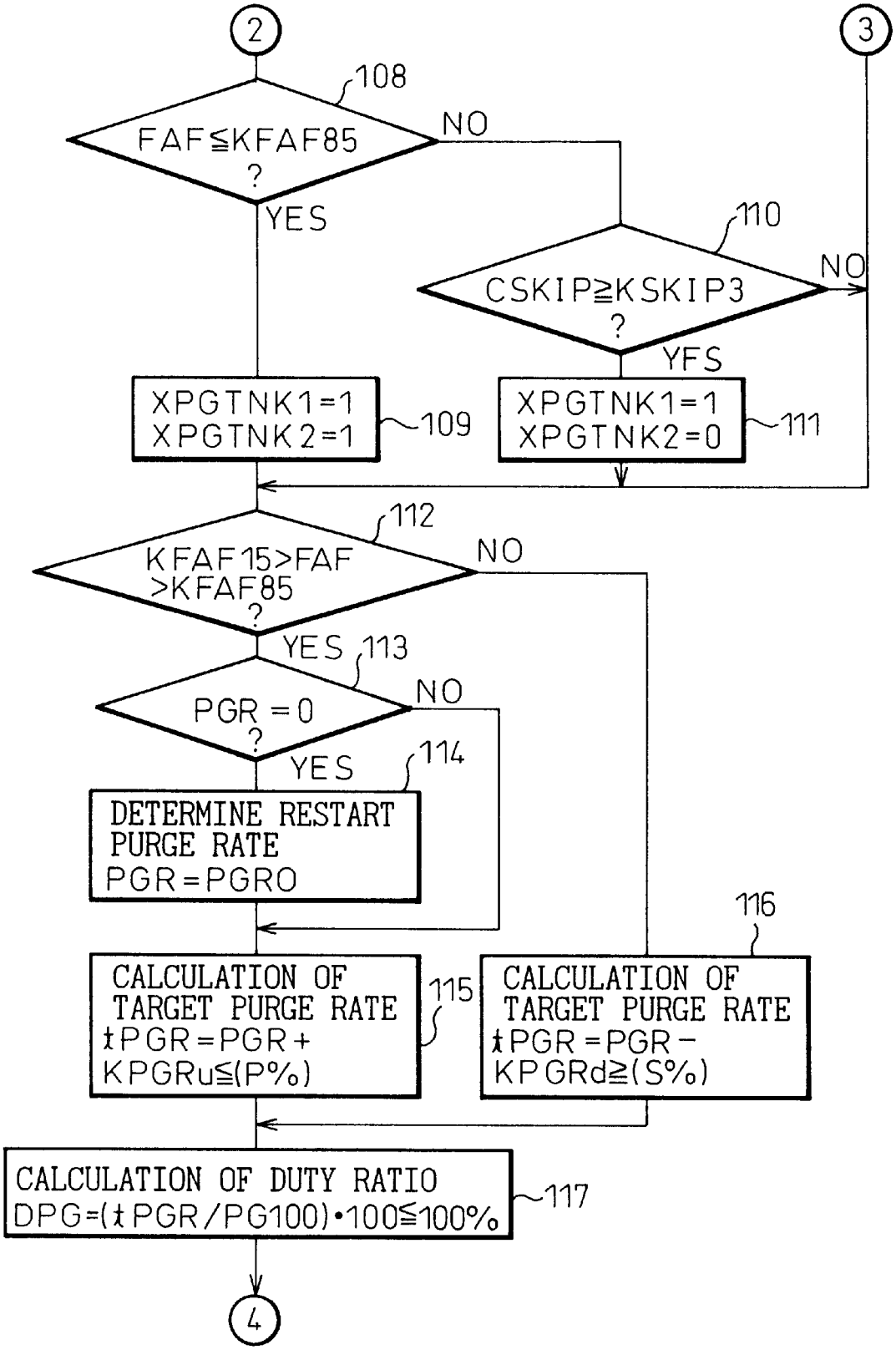
Figure 13:
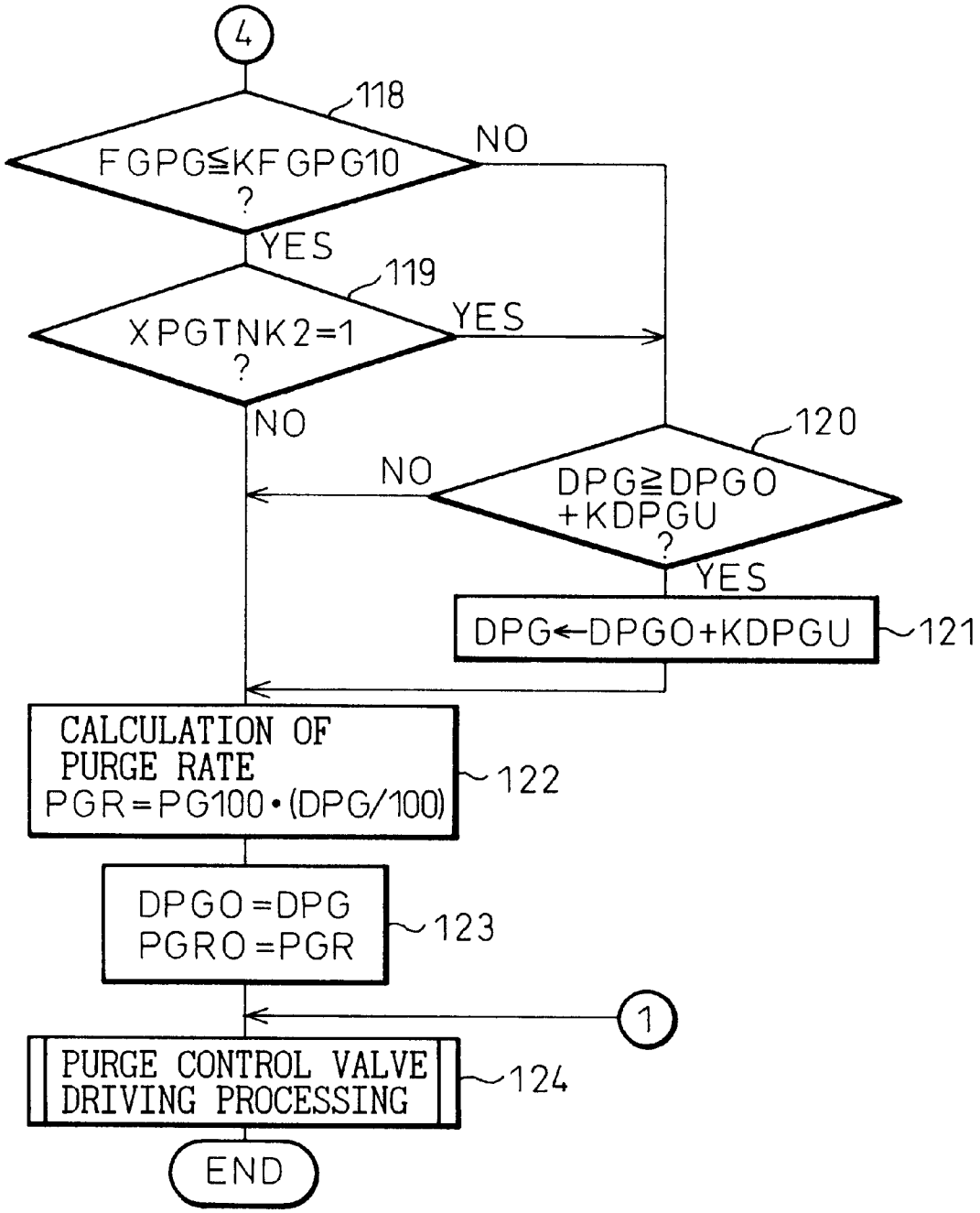

A second embodiment of the routine for control of the purge operation is shown in FIG. 11 to FIG. 13. Step 100 to step 124 of this routine correspond to step 100 to step 124 of FIG. 7 to FIG. 9. All the steps among step 100 to step 124 except for step 104' are the same as the corresponding steps of FIG. 7 to FIG. 9. Only step 104' differs from the corresponding step 104 of FIG. 7 to FIG. 9. Therefore, only step 104' of the second embodiment will be explained.

That is, referring to FIG. 11, at step 104', it is judged if the idling flag XIDL has been reset and the number of occurrences CSKIP of the skip action of the feedback correction coefficient FAF has reached three times or more. When the idling flag XIDL has been reset and the number of occurrences CSKIP of the skip action of the feedback correction coefficient FAF has reached three times or more, that is, when the engine is not idling and the feedback control of the air-fuel ratio is stable, the routine proceeds to step 105, where the judgement completion flag XPGTNK1 is reset.

That is, in the embodiment shown in FIG. 7 to FIG. 9, the judgement completion flag was reset when the idling flag XIDL was reset, but in the second embodiment; the judgement completion flag is reset first only when the idling flag XIDL is reset and also the number of occurrences CSKIP of skip actions has reached three or more. In the first embodiment, further, the rich flag XPGTNK2 was set at the time of engine idling, the throttle valve 9 was temporarily opened after the learning of the purge vapor concentration FGPG had progressed, then the deviation of the air-fuel ratio was judged again when the engine again began idling. At this time, FAF>0.85 and therefore the rich flag XPGTNK2 was reset. That is, while the speed of opening of the purge control valve 17 should have been restricted even after that, the speed of opening of the purge control valve 17 was no longer restricted.

Therefore, in the second embodiment, when the throttle valve 9 is temporarily made to open, the judgement completion flag XPGTNK1 is reset when the number of occurrences CSKIP of the skip action reaches three or more to continue to set the rich flag XPGTNK2 so that deviation of the air-fuel ratio is not judged again.

Figure 14:
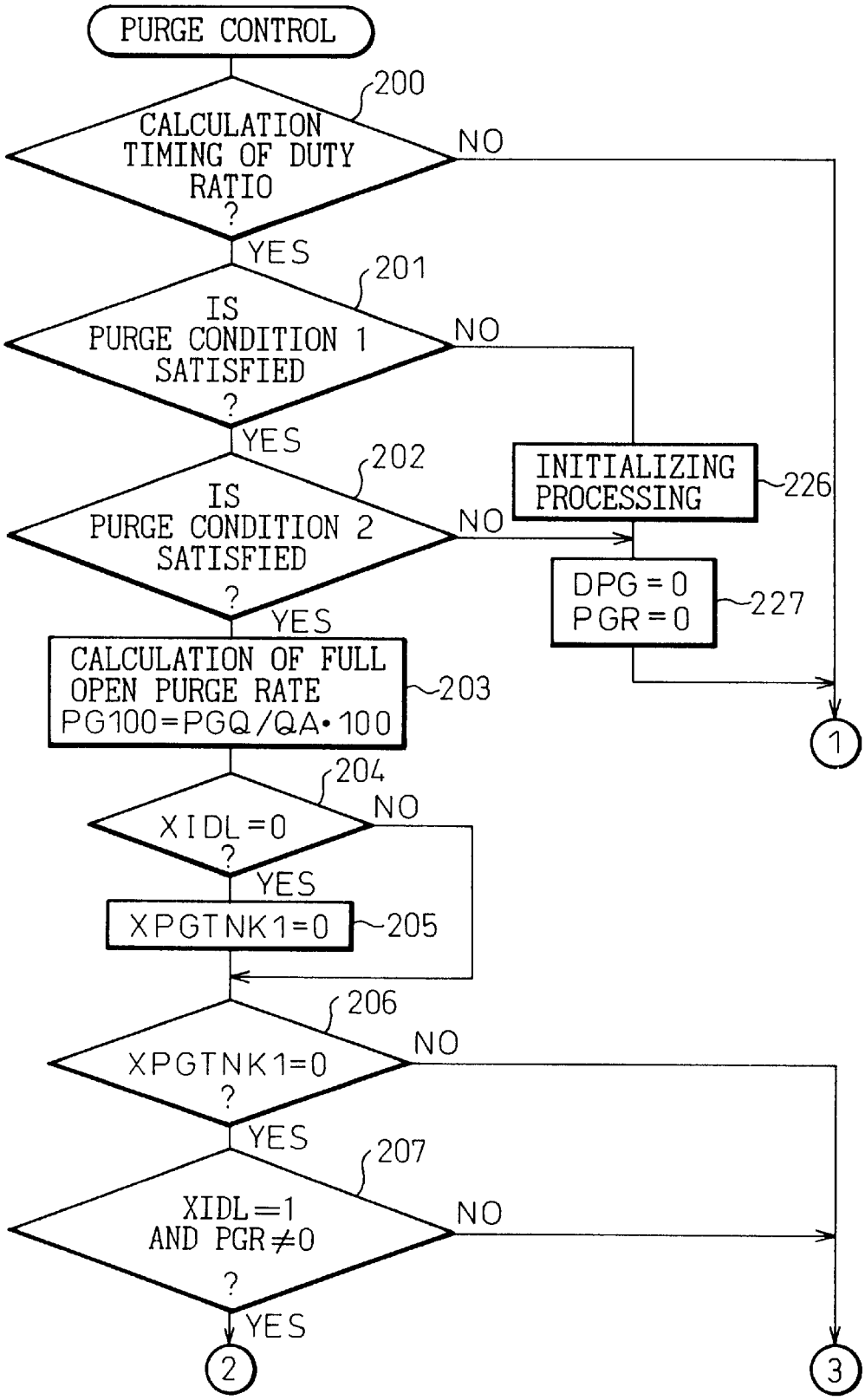
FIGS. 14 and 16 are flow charts for the execution of a third embodiment of the purge control.
Figure 15:
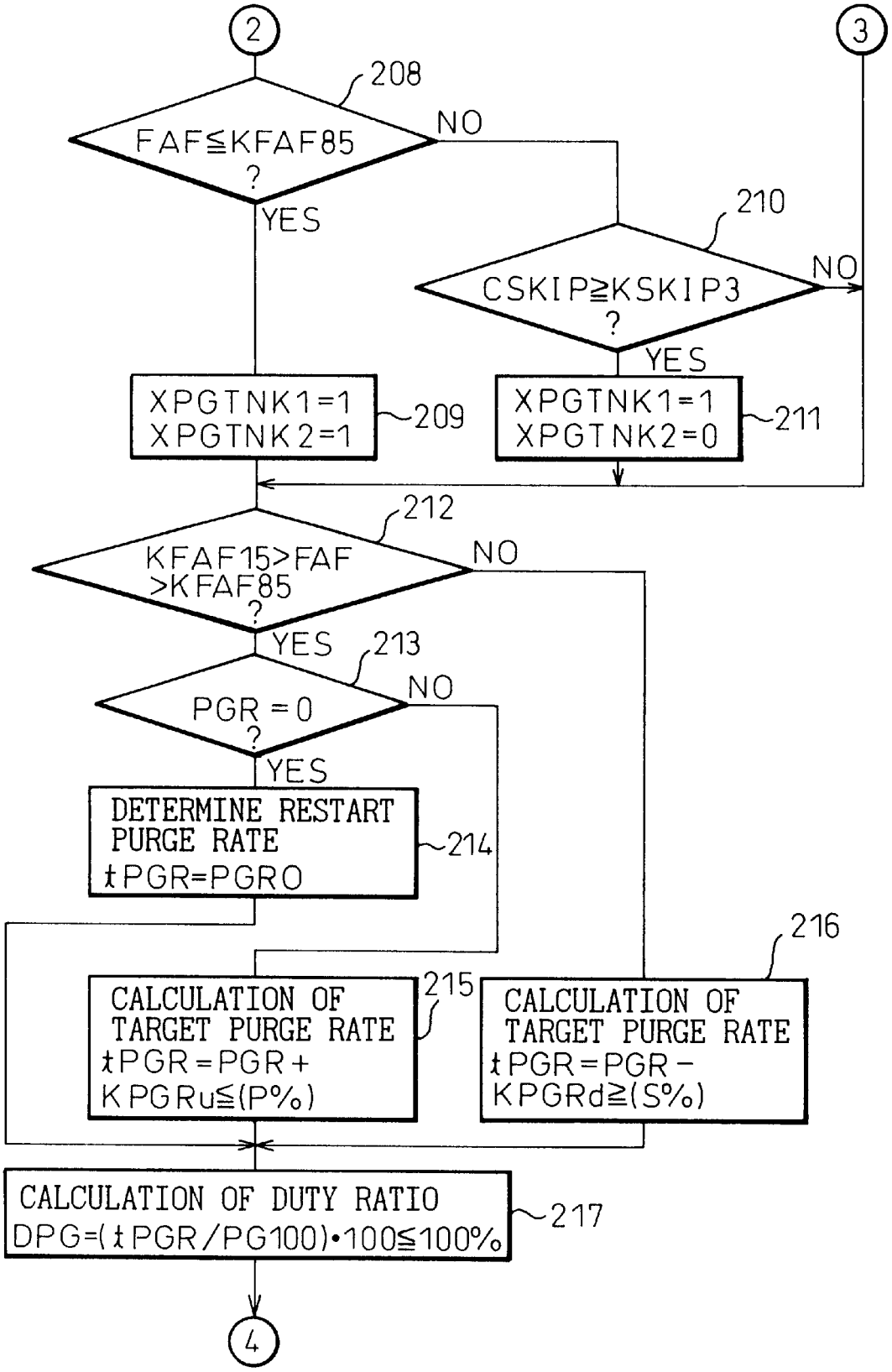
Figure 16:
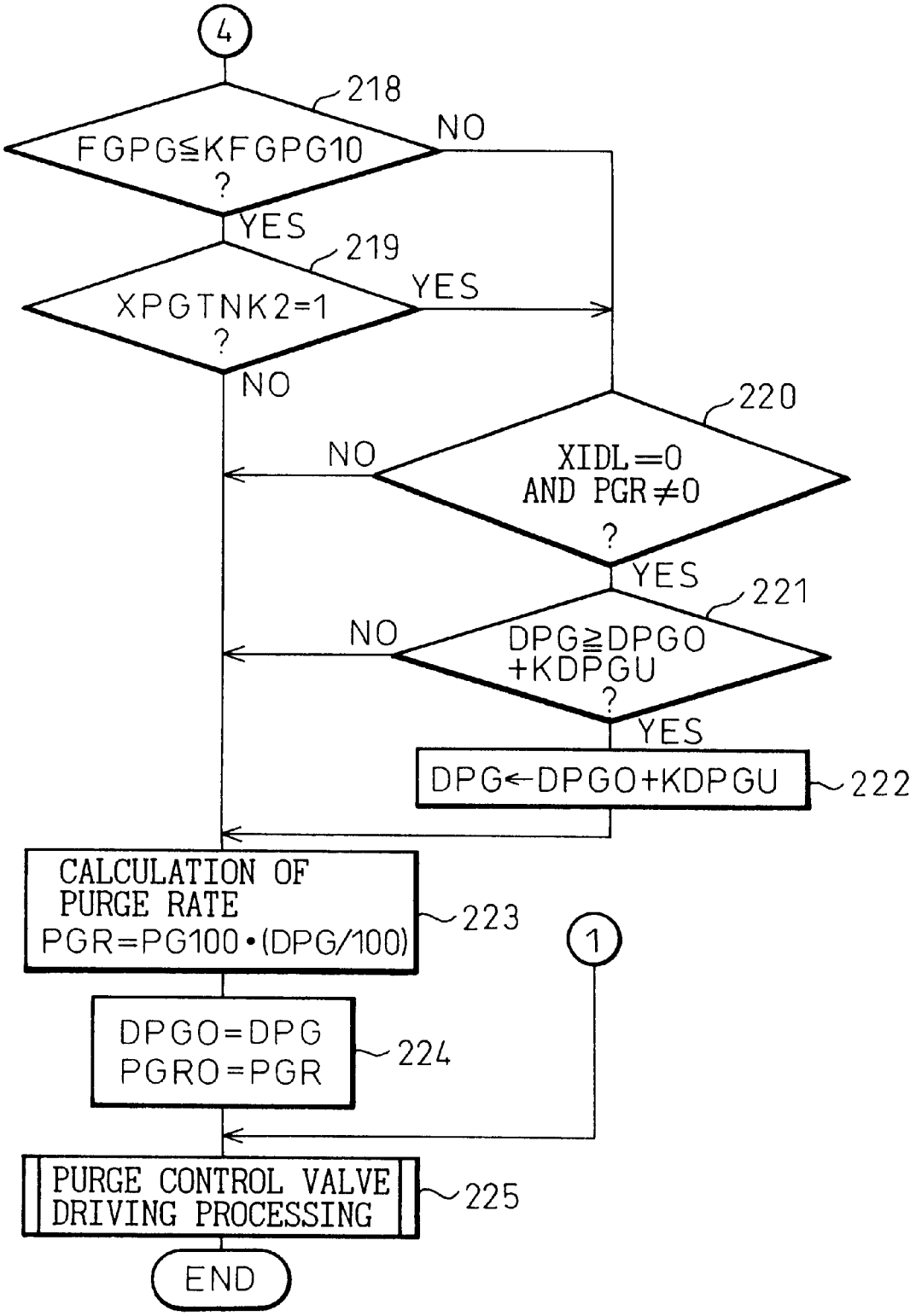
Figure 17:
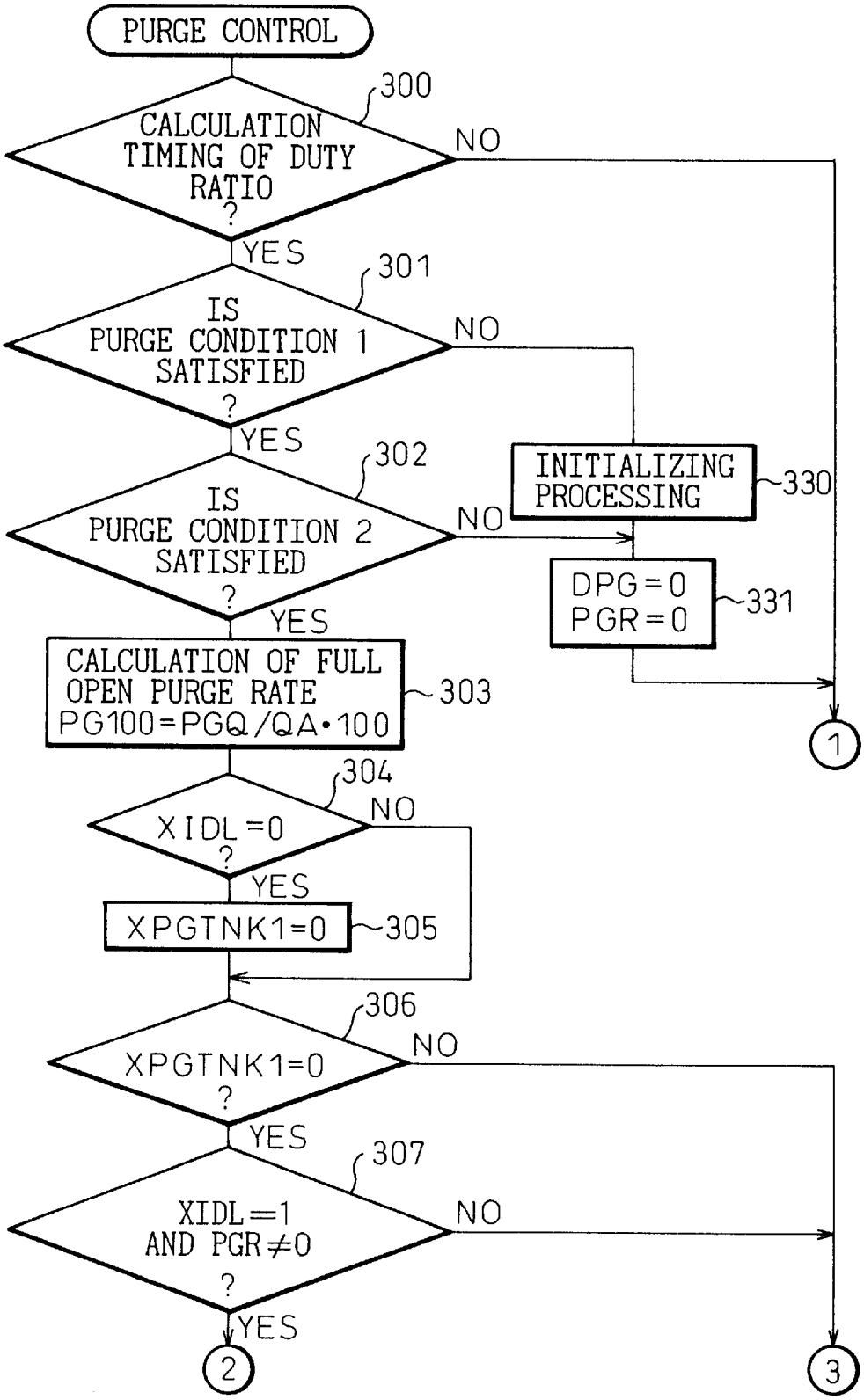
FIGS. 17 to 20 are flow charts for the execution of a fourth embodiment of the purge control.
Figure 18:
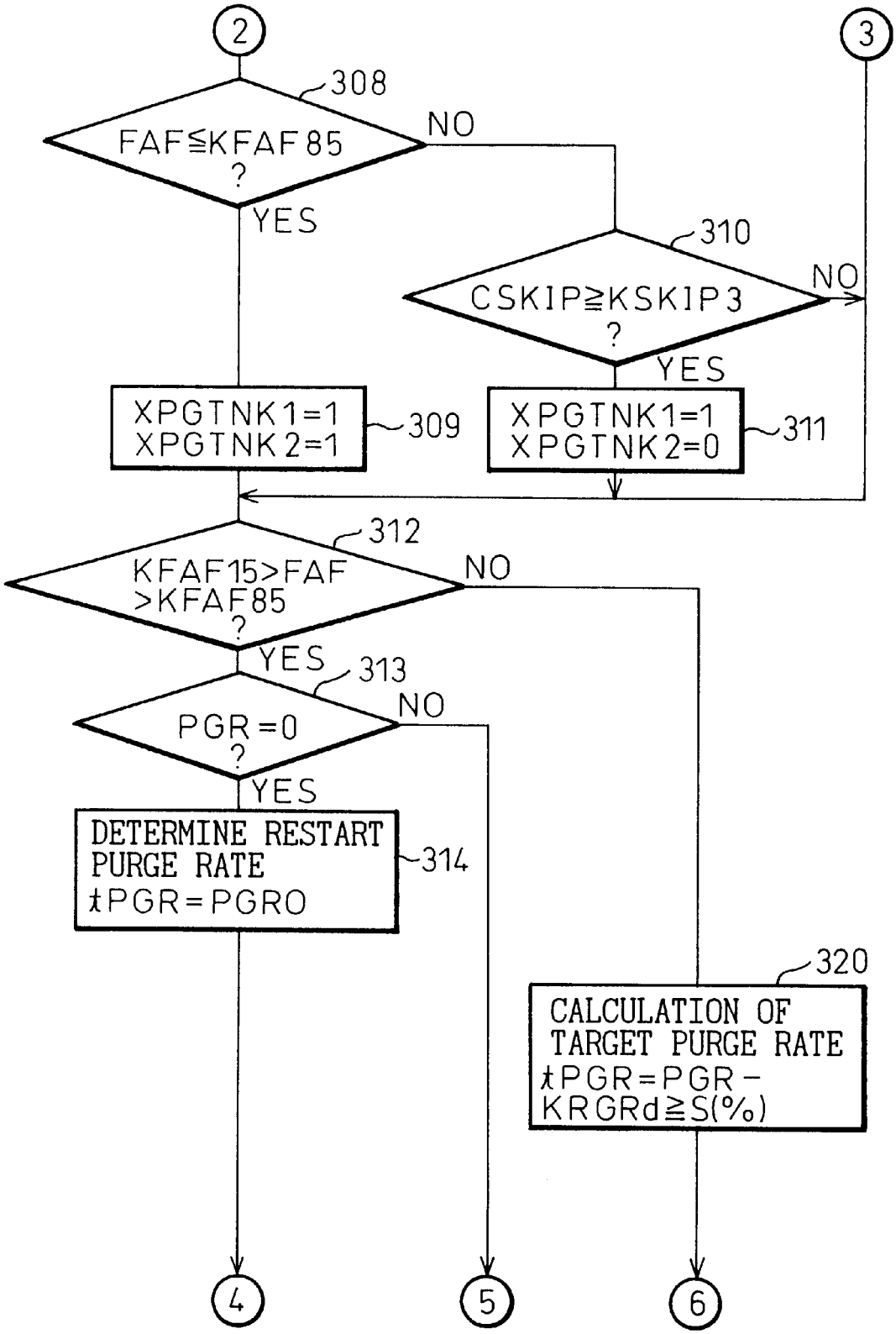
Figure 19:
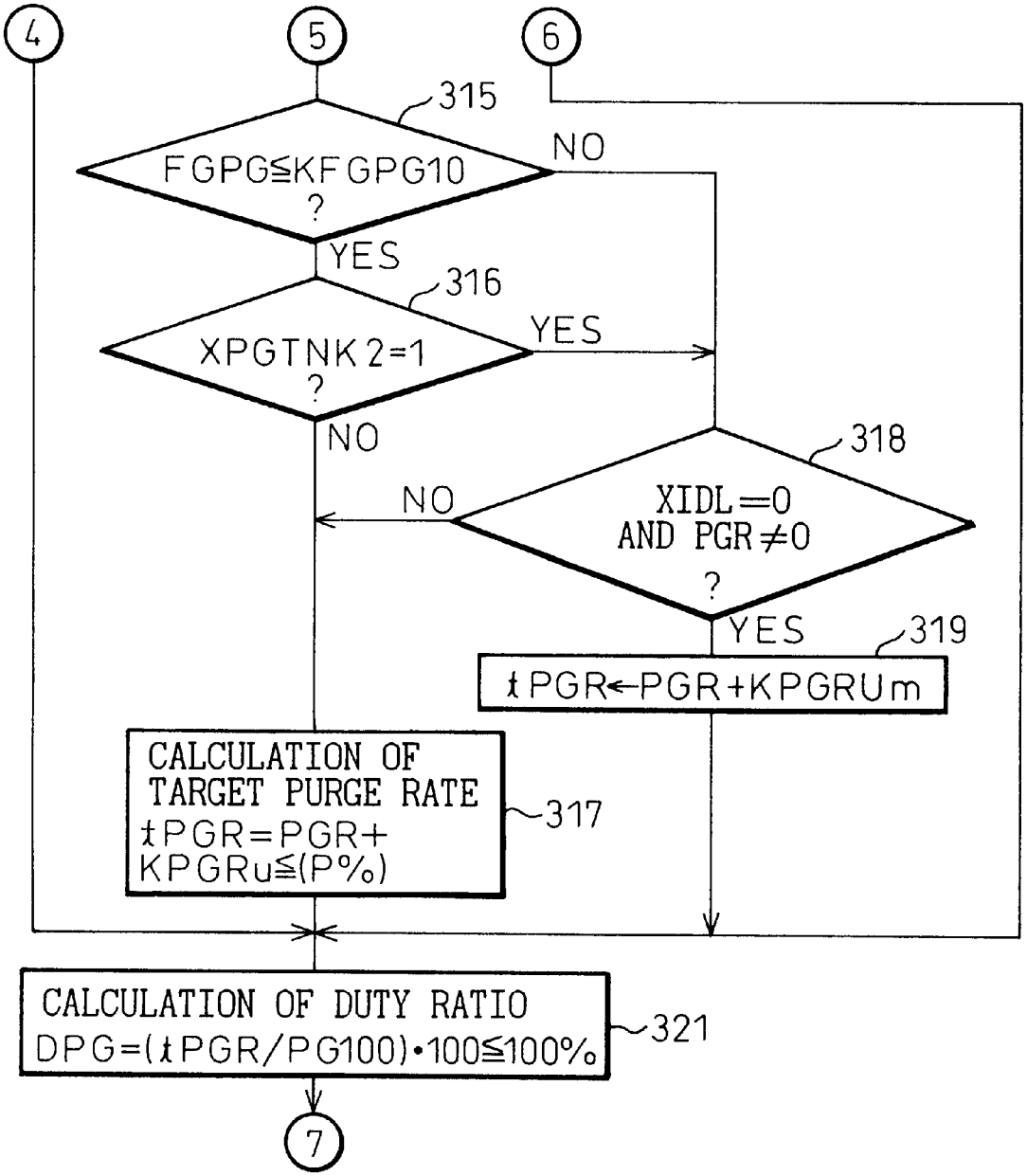
Figure 20:
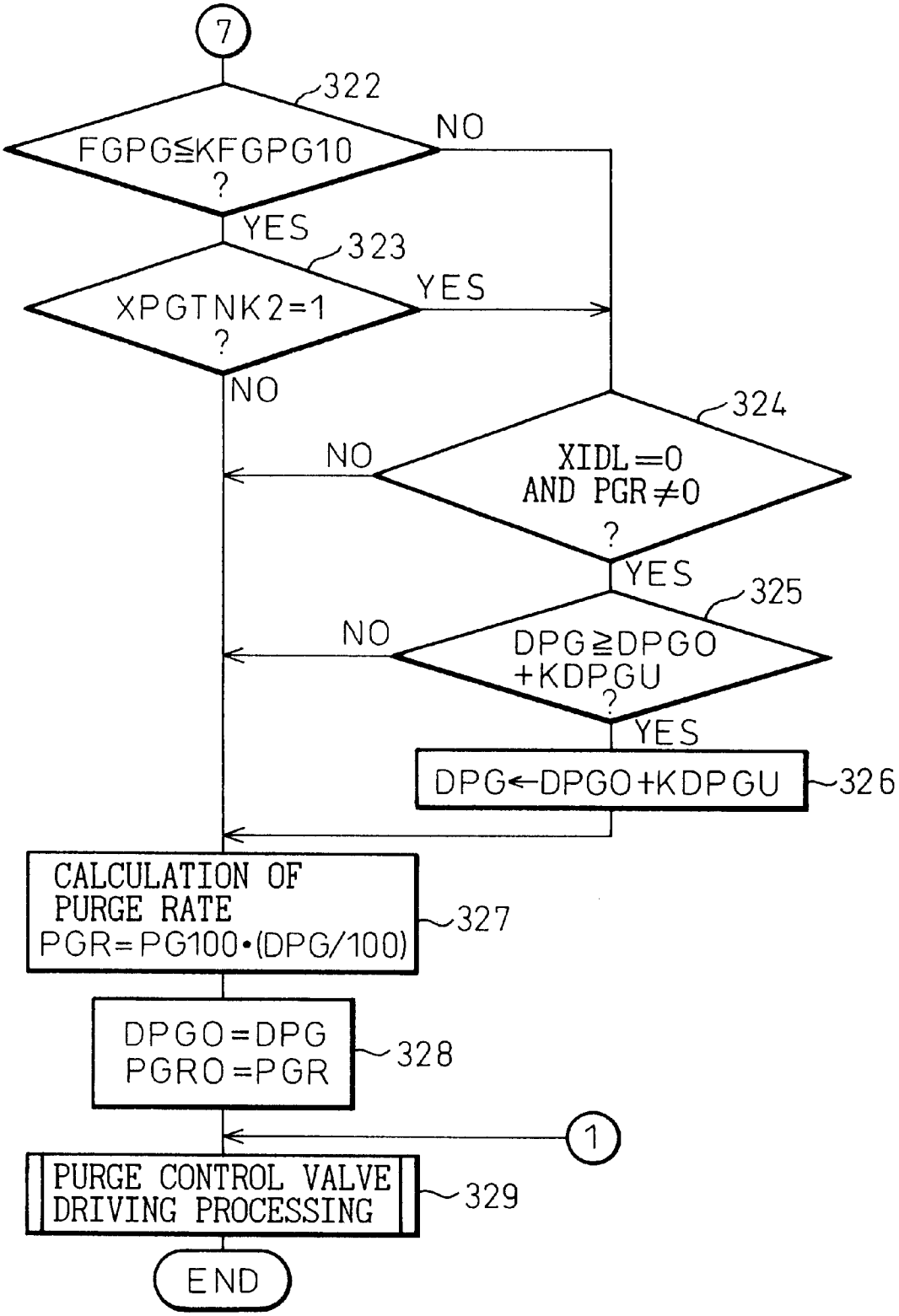

A third embodiment of the routine for control of the purge action is shown in FIG. 14 to FIG. 16.

Referring to FIG. 14 to FIG. 16, first, at step 200, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 225, where the processing for driving the purge control valve 17 is executed. As opposed to this, when it is the time for calculation of the duty ratio, the routine proceeds to step 201, where it is judged if the purge condition 1 is satisfied or not, for example, if the engine warmup has been completed or not. When the purge condition 1 is not satisfied, the routine proceeds to step 226, where the initialization processing is performed, then at step 227, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, the routine proceeds to step 227, while when the purge condition 2 is satisfied, the routine proceeds to step 203.

At step 203, the ratio between the full open purge amount PGQ and the amount QA of intake air, that is, the full open purge rate PG100 (=(PGQ/QA)·100) is calculated. Next, at step 204, it is judged if the idling flag XIDL, which is set when the engine operating state is an idling state, has been reset (XIDL=0) or not. When the idling flag XIDL is set (XIDL=1), that is, when the engine is idling, the routine jumps to step 206, while when the idling flag XIDL is reset, that is, the engine is not in the idling state, the routine proceeds to step 205, where the judgement completion flag XPGTNK1 is reset (XPGTNK1=0), then the routine proceeds to step 206.

At step 206, it is judged if the judgement completion flag XPGTNK1 has been reset or not. When the judgement completion flag XPGTNK1 is set, that is, when the judgement of deviation of the air-fuel ratio is completed, the routine jumps to step 212. As opposed to this, when the judgement completion flag XPGTNK1 is reset, that is, the judgement of the deviation of the air-fuel ratio has not been completed, the routine proceeds to step 207, where it is judged if the condition for judgement of deviation of the air-fuel ratio is satisfied or not. It is judged that the condition for judgement of deviation of the air-fuel ratio is satisfied when the idling flag XIDL is set and the purge rate PGR is not zero, that is, during an engine idling operation where the purge action of the fuel vapor is performed. When the condition for judgement of the deviation of the air-fuel ratio is not satisfied, the routine jumps to step 212, while when the condition for judgement of the deviation of the air-fuel ratio is satisfied, the routine proceeds to step 208.

At step 208, it is judged if the feedback correction coefficient FAF has become smaller than the set value KFAF85 (=0.85) or not. When FAF>KFAF85, the routine proceeds to step 210, where it is judged if the number of occurrences CSKIP of the skip action of the feedback correction coefficient FAF has exceeded a set number KSKIP3, for example, three times, or not. When CSKIP<KSKIP3, the routine jumps to step 212. As opposed to this, when CSKIP≧KSKIP3, the routine proceeds to step 211, where the judgement completion flag XPGTNK1 is set (XPGTNK1=1) and the rich flag XPGTNK2 showing that the air-fuel ratio has become rich is reset (XPGTNK2=0). On the other hand, when it is judged at step 208 that FAF≦KFAF85, the routine proceeds to step 209, where the judgement completion flag XPGTNK1 is set (XPGTNK1=1) and the rich flag XPGTNK2 is set (XPGTNK2=1).

Next, at step 212, it is judged if the feedback control coefficient FAF is between the upper limit value KFAF15

(=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 213, where it is judged whether the purge rate PGR is zero or not. That is, when the purge action is being performed, PGR>0, so at this time the routine jumps to step 215. At step 215, the target purge rate tPGR (=PGR+KPRGu) is calculated by adding a constant value KPGRu to the purge rate PGR, then the routine proceeds to step 217. As opposed to this, when the purge action has not started, the routine proceeds to step 214, where the purge rate PGR0 is made the restart purge rate PGR, then the routine proceeds to step 217.

On the other hand, when it is judged at step 212 that FAF≧KFAF15 or FAF≦KFAF85, the routine proceeds to step 216, where the constant value KPGRd is subtracted from the purge rate PGR to calculate the target purge rate tPGR (=PGR−KPGRd). Next, the routine proceeds to step 217. At step 217, the target purge rate tPGR is divided by the full open purge rate PG100 to calculate the duty ratio DPG (=(tPGR/PG100)−100) of the drive pulse of the purge control valve 17.

Next, at step 218, it is judged if the purge vapor concentration FGPG is lower than the set value KFPGP10, for example, 10 percent, or not. When FGPG≦KFGPG10, the routine proceeds to step 219, where it is judged if the rich flag XPGTNK2 has been set or not. When the rich flag XPGTNK2 has been reset, the routine proceeds to step 223. As opposed to this, when it judged at step 218 that FGPG>KFGPG10, that is, when it is judged when the fuel vapor concentration FGPG is high, the routine proceeds to step 220, while when it is judged at step 219 that the rich flag XPGTNK2 is set, that is, the air-fuel ratio deviates from the stoichiometric air-fuel ratio, the routine proceeds to step 220.

At step 220, it is judged if the condition for restriction of the speed of opening of the purge control valve 17 is satisfied or not. This condition is satisfied when the idling flag XIDL is reset and the purge rate PGR is not zero, that is, in an engine operation state other than idling when a purge action is being performed. When the condition for restriction of the speed of opening of the purge control valve 17 is not satisfied, that is, during engine idling or when the purge rate PGR is zero, the routine jumps to step 223, while when the condition for restriction of the speed of opening of the purge control valve 17 is satisfied, the routine proceeds to step 221.

At step 221, it is judged if the duty ratio DPG calculated at step 217 is larger than the value of the previously calculated duty ratio DPG0 plus a constant value KDPGU (DPG0+KDPGU) or not. When DPG<DPG0+KDPGU, the routine jumps to step 223, while when DPG≧DPG0+KDPGU, the routine proceeds to step 222 where (DPG0+KDPGU) is made the duty ratio DPG. That is, when the duty ratio DPG increases by only less than the constant value KDPGU, the duty ratio calculated at step 217 is used as it is as the duty ratio. When the duty ratio DPG increases by more than the constant value KDPGU, the amount of increase of the duty ratio DPG is controlled to the constant value KDPGU.

At step 223, the full open rate PG100 is multiplied by the duty ratio DPG to calculate the actual purge rate PGR (=PG100·(DPG/100)). Next, at step 224, the duty ratio DPG is made DPG0 and the purge rate PGR is made PGR0. Next, at step 225, processing is performed to drive the purge control valve 17 as shown in FIG. 10.

When desiring to have the fuel vapor adsorbed by the activated carbon 10 in the canister 11, it is necessary to purge the fuel vapor adsorbed by the activated carbon 10 as early as possible so that the adsorption ability of the activated carbon 10 does not become saturated. If the speed of opening of the purge control valve 17 is restricted to a constant speed so as to suppress fluctuations in the air-fuel ratio, however, the amount of purge of the fuel vapor is suppressed as well. Therefore, in the third embodiment, the speed of opening of the purge control valve 17 is not restricted at the time of engine idling and when the purge rate PRG is zero so as to purge the fuel vapor from the activated carbon 10 as early as possible.

That is, even when the purge vapor concentration FGPG is high or the rich flag XPGTNK2 is set, if the engine is idling, the routine jumps from step 220 to step 223 and therefore the amount of opening of the purge control valve 17 is controlled in accordance with the duty ratio DPG calculated at step 217. Further, even when the purge rate PGR is zero, the routine jumps from step 220 to step 223. The purge rate PGR is judged to be zero when the purge action is started for the first time after the engine starts operating and when the purge action once stops and then is restarted during engine operation.

In this way, in the third embodiment, at the time of engine idling, when the purge action is performed for the first time, and when the purge action is restarted, the amount of valve opening is controlled in accordance with the duty ratio DPG calculated at step 217. In particular, when restarting the purge action, if the duty ratio DPG calculated is larger than the duty ratio DPG0 at the time of the suspension of the purge action, in the first and second embodiments, the duty ratio DPG was restricted to (DPG0+KDPGU), but in the third embodiment, the duty ratio DPG is not restricted at all and is made a large ratio. Therefore, in the third embodiment, it is possible to purge the fuel vapor adsorbed by the activated carbon 10 into the intake passage faster than in the first embodiment and the second embodiment.

On the other hand, in this embodiment, when the purge vapor concentration FPG is high or the rich flag DXPGTNK2 is set, if the engine is not idling and the purge action is being performed, the amount of increase of the duty ratio GDP of the drive pulse of the purge control valve 17 is restricted. If the amount of increase of the duty ratio DPG is restricted, however, the amount of purge will not easily increase at the time of repeated acceleration and deceleration.

That is, if the engine accelerates, the full open purge rate PG100 calculated at step 203 becomes small, so the duty ratio DPG calculated at step 217 becomes larger. If the amount of increase of the duty ratio DPG is restricted at this time, however, the duty ratio DPG will increase only slightly despite the full open purge rate PG100 becoming smaller, so the actual purge rate PGR calculated at step 223 will fall. Therefore, later, the target purge rate tPGR will rise gradually from the fallen purge rate PGR in increments of the constant value KPGRu. Next, when the engine decelerates, the target purge rate tPGR will rise gradually in increments of the constant value KPGRu.

Next, when the engine accelerates again, if the amount of increase of the duty ratio DPG is restricted, the duty ratio DPG will increase only slightly despite the full open purge rate PG100 becoming small, so the actual purge rate PGR calculated at step 223 will fall once again. If acceleration and deceleration are repeated in this way, the purge rate PGR will fall each time the engine accelerates and therefore the amount of purge will not easily increase.

Therefore, in the fourth embodiment, the rate of increase of the target purge rate tPGR is increased when the amount of increase of the duty ratio DPG is restricted so that the amount of purge will increase even with repeated acceleration and deceleration. That is, even when the amount of increase of the duty ratio DPG is restricted, if the rate of increase of the target purge rate tPGR is increased, the rate of increase of the duty ratio DPG will increase along with it, so the duty ratio DPG will become considerably large during acceleration and deceleration following the same. Therefore, even if the engine later accelerates and the amount of increase of the duty ratio DPG is restricted at that time, since the duty ratio DPG has become large, the purge rate PGR will not become small and therefore the amount of purge can be increased.

FIG. 17 to FIG. 20 show a routine for control of a purge action in this fourth embodiment.

Referring to FIG. 17 to FIG. 20, first, at step 300, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 329, where the processing for driving the purge control valve 17 is executed. As opposed to this, when it is the time for calculation of the duty ratio, the routine proceeds to step 301, where it is Judged if the purge condition 1 is satisfied or not, for example, if the engine warmup has been completed or not. When the purge condition 1 is not satisfied, the routine proceeds to step 330, where the initialization processing is performed, then at step 331, the duty ratio DPG and the purge rate PGR are made zero. As opposed to this, when the purge condition 1 is satisfied, the routine proceeds to step 302, where it is judged if the purge condition 2 is satisfied or not, for example, whether feedback control of the air-fuel ratio is being performed or not. When the purge condition 2 is not satisfied, the routine proceeds to step 331, while when the purge condition 2 is satisfied, the routine proceeds to step 303.

At step 303, the ratio between the full open purge amount PGQ and the amount QA of intake air, that is, the full open purge rate PG100 (=(PGQ/QA)·100) is calculated. Next, at step 304, it is judged if the idling flag XIDL, which is set when the engine operating state is an idling state, has been reset (XIDL=0) or not. When the idling flag XIDL is set (XIDL=1), that is, when the engine is idling, the routine jumps to step 306, while when the idling flag XIDL is reset, that is, the engine is not in the idling state, the routine proceeds to step 305, where the judgement completion flag XPGTNK1 is reset (XPGTNK1=0), then the routine proceeds to step 306.

At step 306, it is judged if the judgement completion flag XPGTNK1 has been reset or not. When the judgement completion flag XPGTNK1 is set, that is, when the judgement of deviation of the air-fuel ratio is completed, the routine jumps to step 312. As opposed to this, when the judgement completion flag XPGTNK1 is reset, that is, the judgement of the deviation of the air-fuel ratio has not been completed, the routine proceeds to step 307, where it is judged if the condition for judgement of deviation of the air-fuel ratio is satisfied or not. It is judged that the condition for judgement of deviation of the air-fuel ratio is satisfied, as mentioned above, when the idling flag XIDL is set and the purge rate PGR is not zero, that is, during an engine idling operation where the purge action of the fuel vapor is performed. When the condition for judgement of the deviation of the air-fuel ratio is not satisfied, the routine jumps to step 312, while when the condition for judgement of the deviation of the air-fuel ratio is satisfied, the routine proceeds to step 308.

At step 308, it is judged if the feedback correction coefficient FAF has become smaller than the set value KFAF85 (=0.85) or not. When FAF>KFAF85, the routine proceeds to step 310, where it is judged if the number of occurrences CSKIP of the skip action of the feedback correction coefficient FAF has exceeded a set number KSKIP3, for example, three times, or not. When CSKIP<KSKIP3, the routine jumps to step 312. As opposed to this, when CSKIP>KSKIP3, the routine proceeds to step 311, where the judgement completion flag XPGTNK1 is set (XPGTNK1=1) and the rich flag XPGTNK2 showing that the air-fuel ratio has become rich is reset (XPGTNK2=0). On the other hand, when it is judged at step 308 that FAF≦KFAF85, the routine proceeds to step 309, where the judgement completion flag XPGTNK1 is set (XPGTNK1=1) and the rich flag XPGTNK2 is set (XPGTNK2=1).

Next, at step 312, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 313, where it is judged whether the purge rate PGR is zero or not. That is, when the purge action is being performed, PGR>0, so at this time the routine jumps to step 315.

At steps 315, 316, and 318, it is judged if the speed of opening of the purge control valve 17 is restricted or not. If the speed of opening of the purge control valve 17 is restricted, the routine proceeds to step 319. That is, at step 315, it is judged if the purge vapor concentration FGPG is lower than the set value KFPG10, for example, 10 percent. When FGPG≦KFGPG10, the routine proceeds to step 316, where it is judged if the rich flag XPGTNK2 has been set or not. When the rich flag XPGTNK2 has been reset, the routine proceeds to step 317. At step 317, the constant value KPGRu is added to the purge rate PGR to calculate the target purge rate tPGR (=PGR+KPGRu), then the routine proceeds to step 321.

As opposed to this, when it judged at step 315 that FGPG>KFGPG10, that is, when the fuel vapor concentration FGPG is high, the routine proceeds to step 318, while when it is judged at step 316 that the rich flag XPGTNK2 is set, that is, the air-fuel ratio deviates from the stoichiometric air-fuel ratio, the routine proceeds to step 318.

At step 318, it is judged if the idling flag XIDL is reset and the purge rate PGR is not zero, that is, if the engine operating state is other than idling and a purge action is being performed. When during engine idling or when the purge rate PGR is zero, the routine proceeds to step 317, while when the engine operating state is other than idling and the purge action is being performed, the routine proceeds to step 319.

At step 319, the constant value KPGRu is added to the purge rate PGR to calculate the target purge rate tPGR. This constant value KPGRUM is larger than the constant value KPGRu at step 317, for example, KPGRUm is made double KPGRu. Therefore, when the speed of opening of the purge control valve 17 is restricted, the rate of increase of the target purge rate tPGR is made to rise.

On the other hand, when it is judged at step 313 that PGR=0, that is, when the purge action has not yet started, the routine proceeds to step 314, where the purge rate PGR0 is made the restart purge rate tPGR, then the routine proceeds to step 321. At step 321, the target purge rate tPGR is divided by the full open purge rate PG100 to calculate the duty ratio DPG of the drive pulse of the purge control valve 17 (=(tPGR/PG100)·100).

Next, at step 322, it is judged if the purge vapor concentration FGPG is lower than the set value KFPGP10, for example, 10 percent, or not. When FGPG s KFGPG10, the routine proceeds to step 323, where it is judged it the rich flag XPGTNK2 has been set or not. When the rich flag XPGTNK2 has been reset, the routine proceeds to step 327. As opposed to this, when it is judged at step 322 that FGPG>KFGPG10, that is, when the purge vapor concentration FGPG is high, the routine proceeds to step 324. Further, when it is judged at step 323 that the rich flag XPGTNK2 is set, that is, the air-fuel ratio deviates from the stoichiometric air-fuel ratio, the routine proceeds to step 324.

At step 324, it is judged if the condition for restriction of the speed of opening of the purge control valve 17 is satisfied or not. This condition is satisfied when the idling flag XIDL is reset and the purge rate PGR is not zero, that is, in an engine operation state other than idling when a purge action is being performed. When the condition for restriction of the speed of opening of the purge control valve 17 is not satisfied, that is, during engine idling or when the purge rate PGR is zero, the routine jumps to step 327, while when the condition for restriction of the speed of opening of the purge control valve 17 is satisfied, the routine proceeds to step 325.

At step 325, it is judged if the duty ratio DPG calculated at step 321 is larger than the value of the previously calculated duty ratio DPG0 plus a constant value KDPGU (DPG0+KDPGU) or not. When DPG<DPG0+KDPGU, the routine jumps to step 327, while when DPG≧DPG0+KDPGU, the routine proceeds to step 326 where (DPG0+KDPGU) is made the duty ratio DPG. Next, the routine proceeds to step 327.

At step 327, the full open rate PG100 is multiplied by the duty ratio DPG to calculate the actual purge rate PGR (=PG100·(DPG/100)). Next, at step 328, the duty ratio DPG is made DPG0 and the purge rate PGR is made PGR0. Next, at step 329, processing is performed to drive the purge control valve 17 as shown in FIG. 10.

As mentioned above, according to the present invention, it is possible to prevent the air-fuel ratio from fluctuating by a large margin when performing a purge action of fuel vapor.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of fuel vapor to be purged to the intake passage;

air-fuel ratio detecting means for detecting the air-fuel ratio;

feedback control means for feedback control of the air-fuel ratio to make the air-fuel ratio a target air-fuel;

purge vapor concentration calculating means for calculating a purge vapor concentration based on an amount of fluctuation of the air-fuel ratio;

correcting means for correcting an amount of fuel to be supplied to the engine based on the purge vapor concentration calculated by the purge vapor concentration calculating means;

deviation judgement means for judging if the purge vapor concentration calculated by the purge vapor concentration calculating means deviates from an actual purge vapor concentration;

calculating means for calculating a target purge rate and for determining a basic purge rate based on a predetermined degree of opening of the purge control valve, wherein the calculating means calculates an actual degree of opening of the purge control valve by dividing the target purge rate by the basic purge rate; and opening speed restricting means for restricting a speed of increase of the calculated degree of opening of the purge control valve to less than a predetermined speed when the calculated purge vapor concentration deviates from the actual purge vapor concentration.

2. An evaporated fuel treatment device as set forth in claim 1, wherein the deviation judgement means judges that deviation has occurred when the air-fuel ratio becomes rich at the time of engine idling.

3. An evaporated fuel treatment device as set forth in claim 2, wherein the feedback control means controls the air-fuel ratio to the target air-fuel ratio by correcting the amount of supplied fuel by a feedback correction coefficient which changes along with the air-fuel ratio detected by the air-fuel ratio detecting means, wherein the feedback correction coefficient fluctuates about a predetermined reference value when the air-fuel ratio is maintained at the target air-fuel ratio, and wherein the deviation judgement means judges that deviation has occurred when the feedback correction coefficient becomes lower than a predetermined value at the time of engine idling.

4. An evaporated fuel treatment device as set forth in claim 3, wherein the purge vapor concentration calculating means increases the purge vapor concentration when the feedback correction coefficient becomes smaller than the reference value and decreases the purge vapor concentration when the feedback correction coefficient becomes larger than the reference value.

5. An evaporated fuel treatment device as set forth in claim 3, wherein the feedback correction coefficient is changed downward in a skipping fashion when the air-fuel ratio changes from lean to rich, and wherein the feedback correction coefficient is changed upward in a skipping fashion when the air-fuel ratio is changed from rich to lean, and wherein releasing means is provided for releasing the restriction on the speed of opening of the purge control valve when the feedback correction coefficient remains at least as high as the predetermined reference value during a period from a start of an idling operation to a time when the feedback correction coefficient has been changed in a skipping fashion a predetermined number of times.

6. An evaporated fuel treatment device as set forth in claim 1, wherein the correcting means corrects the amount of fuel supplied so that the amount of fuel supplied becomes smaller as the purge vapor concentration increases.

7. An evaporated fuel treatment device as set forth in claim 1, wherein the predetermined degree of opening of the purge control valve is a fully open condition.

8. An evaporated fuel treatment device as set forth in claim 7, wherein the opening speed restricting means opens the purge control valve by a speed of increase of the calculated amount of opening of the purge control valve when the speed of increase of the calculated amount of opening is not more than a predetermined speed and makes the speed of increase of the amount of opening of the purge control valve a predetermined speed when the speed of increase of the calculated amount of opening of the purge control valve is more than the predetermined speed.

9. An evaporated fuel treatment device as set forth in claim 1, wherein judgement means is provided for judging if the purge vapor concentration calculated by the purge vapor concentration calculating means has become higher than a predetermined concentration and wherein the opening speed restricting means restricts the speed of opening of the purge control valve to less than the predetermined speed when the calculated purge vapor concentration becomes higher than the predetermined concentration.

10. An evaporated fuel treatment device as set forth in claim 1, wherein stability judgement means is provided for judging if feedback control of the air-fuel ratio by the feedback control means is stable in an operating state other than engine idling and wherein the deviation judgement means judges that deviation has occurred when the engine idles after the stability judgement means judges that the feedback control of the air-fuel ratio is stable.

11. An evaporated fuel treatment device as set forth in claim 10, wherein the feedback correction coefficient is changed downward in a skipping fashion when the air-fuel ratio changes from lean to rich, the feedback correction coefficient is changed upward in a skipping fashion when the air-fuel ratio is changes from rich to lean, and the stability judgement means Judges that the feedback control of the air-fuel ratio is stable when the skip-like change of the feedback correction coefficient has been performed a predetermined time or more in a state other than engine idling.

12. An evaporated fuel treatment device as set forth in claim 1, wherein releasing means is provided for releasing the restriction of the speed of opening of the purge control valve by the opening speed restricting means directly after a purge action has started.

13. An evaporated fuel treatment device as set forth in claim 12, wherein releasing means is provided for releasing the restriction of the speed of opening of the purge control valve by the opening speed restricting means in an operating state other than engine idling directly after a purge action has started.

14. An evaporated fuel treatment device as set forth in claim 1, wherein the actual degree of opening of the purge control valve is increased by a predetermined ratio and wherein the predetermined ratio is increased when the speed of opening of the purge control valve is restricted to less than a predetermined speed by the opening speed restricting means.

15. An evaporated fuel treatment device as set forth in claim 14, wherein releasing means is provided for releasing the restriction of the speed of opening of the purge control valve by the opening speed restricting means in an operating state other than engine idling.

16. An evaporated fuel treatment device as set forth in claim 15, wherein releasing means is provided for releasing the restriction of the speed of opening of the purge control valve by the opening speed restricting means in an operating state other than engine idling directly after a purge action has started.

17. An evaporated fuel treatment device for an engine provided with an intake passage, comprising:

a purge control valve for controlling an amount of fuel vapor to be purged to the intake passage;

air-fuel ratio detecting means for detecting the air-fuel ratio;

feedback control means for feedback control of the air-fuel ratio to make the air-fuel ratio a target air-fuel;

purge vapor concentration calculating means for calculating a purge vapor concentration based on an amount of fluctuation of the air-fuel ratio;

correcting means for correcting an amount of fuel to be supplied to the engine based on the purge vapor concentration calculated by the purge vapor concentration calculating means;

deviation judgement means for judging if the purge vapor concentration calculated by the purge vapor concentration calculating means deviates from an actual purge vapor concentration, wherein the deviation judgement means judges that deviation has occurred when the air-fuel ratio becomes rich at the time of engine idling; and opening speed restricting means for restricting a speed of opening of the purge control valve to less than a predetermined speed when the calculated purge vapor concentration deviates from the actual purge vapor concentration.

18. An evaporated fuel treatment device as set forth in claim 17, wherein the feedback control means controls the air-fuel ratio to the target air-fuel ratio by correcting the amount of supplied fuel by a feedback correction coefficient which changes along with the air-fuel ratio detected by the air-fuel ratio detecting means, wherein the feedback correction coefficient fluctuates about a predetermined reference value when the air-fuel ratio is maintained at the target air-fuel ratio, and the deviation judgement means judges that deviation has occurred when the feedback correction coefficient becomes lower than a predetermined value at the time of engine idling.

19. An evaporated fuel treatment device as set forth in claim 18, wherein the purge vapor concentration calculation means increases the purge vapor concentration when the feedback correction coefficient becomes smaller than the reference value and decreases the purge vapor concentration when the feedback correction coefficient becomes larger than the reference value.

20. An evaporated fuel treatment device as set forth in claim 18, wherein the feedback correction coefficient is changed downward in a skipping fashion when the air-fuel ratio changes from lean to rich, and wherein the feedback correction coefficient is changed upward in a skipping fashion when the air-fuel ratio is changes from rich to lean, and wherein releasing means is provided for releasing the restriction on the speed of opening of the purge control valve when the feedback correction coefficient remains at least as high as the predetermined reference value during a period from a start of an idling operation to a time when the feedback correction coefficient has been changed in a skipping fashion a predetermined number of times.

* * * * *

UNITED STATES PATENT AND TRADEMARK OFFICE

CERTIFICATE OF CORRECTION

PATENT NO. : 5,944,003

DATED : August 31, 1999

INVENTOR(S) : Akinori OSANAI

It is certified that error appears in the above-identified patent and that said Letters Patent is hereby corrected as shown below:

Column 5, line 39, change "AFPGA" to --ΔFPGA--.

Column 7, line 14, change "Judged" to --judged--.

Column 7, line 25, delete "10".

Column 9, line 43, change "LTPG" to --tTPG--.

Column 11, line 43, change "embodiment;" to --embodiment,--.

Column 13, line 20, change "(=(tPGR/PG100)-100)" to --(=(tPGR/PG100)·100)--.

Column 15, line 25, change "Judged" to --judged--.

Column 16, line 11, change "CSKIP>KSKIP3," to --CSKIP≧KSKIP3,--.

Column 16, line 57, change "KPGRUM" to --KPGRUm--.

Column 17, line 5, change "FGPG s" to --FGPG≦--.

UNITED STATES PATENT AND TRADEMARK OFFICE

CERTIFICATE OF CORRECTION

PATENT NO. : 5,944,003

DATED : August 31, 1999

INVENTOR(S) : Akinori OSANAI

It is certified that error appears in the above-identified patent and that said Letters Patent is hereby corrected as shown below:

Column 17, line 6, change "judged it" to --judged if--.

Column 19, line 21, change "changes" to --changed--.

Column 20, line 49, change "changes" to --changed--.

Signed and Sealed this

Ninth Day of January, 2001

*Attest:*

Q. TODD DICKINSON

*Attesting Officer*

*Commissioner of Patents and Trademarks*